US008265857B2

(12) United States Patent
Murai et al.

(10) Patent No.: US 8,265,857 B2
(45) Date of Patent: Sep. 11, 2012

(54) APPARATUS FOR AND METHOD OF CONTROLLING ENGINE

(75) Inventors: Atsushi Murai, Isesaki (JP); Tomoyuki Murakami, Isesaki (JP)

(73) Assignee: Hitachi, Ltd., Tokyo (JP)

( * ) Notice: Subject to any disclaimer, the term of this patent is extended or adjusted under 35 U.S.C. 154(b) by 563 days.

(21) Appl. No.: 12/470,696

(22) Filed: May 22, 2009

(65) Prior Publication Data

US 2009/0288620 A1 Nov. 26, 2009

(30) Foreign Application Priority Data

May 26, 2008 (JP) ..... 2008-136293

(51) Int. Cl.
*F02D 41/04* (2006.01)
*F01L 1/34* (2006.01)

(52) U.S. Cl. ..... 701/105; 701/103; 123/90.17

(58) Field of Classification Search ..... 701/101–105, 701/110, 114, 115; 123/90.11, 90.15–90.17, 123/90.23, 321–323, 345–348
See application file for complete search history.

(56) References Cited

U.S. PATENT DOCUMENTS

| | | | | |
|---|---|---|---|---|
| 6,513,468 | B2 * | 2/2003 | Takahashi et al. | 123/90.15 |
| 6,820,579 | B2 | 11/2004 | Kawamura et al. | |
| 7,107,951 | B2 * | 9/2006 | Urushihata et al. | 123/90.17 |
| 7,201,124 | B2 * | 4/2007 | Neubauer et al. | 123/90.17 |
| 7,403,849 | B1 * | 7/2008 | Watanabe et al. | 701/102 |
| 7,484,497 | B2 * | 2/2009 | Watanabe et al. | 123/345 |
| 7,997,241 | B2 | 8/2011 | Kamiyama et al. | |
| 2004/0011311 | A1 * | 1/2004 | Takahashi | 123/90.15 |
| 2006/0229797 | A1 * | 10/2006 | Sawada et al. | 701/114 |
| 2007/0095311 | A1 | 5/2007 | Tateno et al. | |
| 2008/0288155 | A1 * | 11/2008 | Watanabe et al. | 701/102 |
| 2009/0255510 | A1 * | 10/2009 | Mashiki et al. | 123/347 |

FOREIGN PATENT DOCUMENTS

| | | | |
|---|---|---|---|
| JP | 08-177434 | A | 7/1996 |
| JP | 2001-065321 | A | 3/2001 |
| JP | 2005-291014 | A | 10/2005 |
| JP | 2006-144723 | A | 6/2006 |
| JP | 2006-348774 | A | 12/2006 |
| JP | 2007-120410 | A | 5/2007 |
| JP | 2007-332942 | A | 12/2007 |
| WO | WO 2006/025565 | A1 | 3/2006 |

OTHER PUBLICATIONS

U.S. Appl. No. 12/470,710, filed May 22, 2009, Murai et al.
A. Murai, U.S. PTO Notice of Allowance, U.S. Appl. No. 12/470,710, dated Jul. 3, 2012, 13 pages.

* cited by examiner

*Primary Examiner* — John T. Kwon
*Assistant Examiner* — Johnny Hoang
(74) *Attorney, Agent, or Firm* — Foley & Lardner LLP

(57) ABSTRACT

The present invention is related to an apparatus for and a method of controlling an engine provided with: a variable operation angle mechanism that is provided for varying a valve operation angle of an engine valve driven by a camshaft, and is capable of varying a center phase of the valve operation angle in response to a variation in the valve operation angle; and a variable valve timing mechanism provided for varying a rotating phase of the camshaft relative to a crankshaft of the engine, in which a target valve operation angle and a target rotating phase is calculated based on the engine operating state, and a correction value for correcting the target rotating phase based on the target valve operation angle is set. Then, the target rotating phase is corrected by the correction value, thereby controlling the variable valve timing mechanism based on the corrected target rotating phase.

18 Claims, 31 Drawing Sheets

VEL RESPONSIVENESS :250CAM/sec
VTC RETARD RESPONSIVENESS :190deg/sec

VEL RESPONSIVENESS : 250CAM/sec
VTC ADVANCE RESPONSIVENESS : 130deg/sec

VEL RESPONSIVENESS : 250CAM/sec
VTC RETARD RESPONSIVENESS : 190deg/sec

APPARATUS FOR AND METHOD OF CONTROLLING ENGINE

BACKGROUND OF THE INVENTION

1. Field of the Invention

The present invention relates to an apparatus for and a method of controlling an engine provided with: a variable operation angle mechanism which varies a valve operation angle of an engine valve driven by a camshaft and varies a center phase of the valve operation angle in response to a variation in the valve operation angle; and a variable valve timing mechanism which varies a rotating phase of the camshaft relative to a crankshaft.

2. Description of the Related Art

Japanese Laid-open (Kokai) Patent Application Publication No. 2005-291014 discloses a variable operation angle mechanism suitable for use in an engine to decrease a valve lift amount and to vary a center phase of a valve operation angle in an advance direction in response to a decrease in the valve operation angle of an intake valve.

Incidentally, in the case where there is employed the combination of the variable operation angle mechanism which varies the center phase of the valve operation angle in response to the variation in the valve operation angle and a variable valve timing mechanism which varies a rotating phase of a camshaft relative to a crankshaft of an engine, even if the rotating phase at that time controlled by the variable valve timing mechanism is kept at an identical condition, the center phase of the valve operation angle might varies depending on the valve operation angle at that time.

Thus, even if the variable valve timing mechanism is controlled based on a desired center phase of the valve operation angle that is demanded depending on an engine operating state, an actual center phase might be shifted from the target center phase depending on how extent the valve operation angle is taking at that time.

SUMMARY OF THE INVENTION

In view of the above problems, an object of the present invention is to provide a novel technique for enabling a center phase of a valve operation angle of an engine valve to be controlled with high accuracy, in an engine provided with: a variable operation angle mechanism which varies the valve operation angle of the engine valve driven by a camshaft and varies the center phase of the valve operation angle in response to a variation in the valve operation angle; and a variable valve timing mechanism which varies a rotating phase of the camshaft relative to the crankshaft of the engine.

In order to achieve the above object, the present invention provides such a novel technical concept of calculating a target valve operation angle and a target rotating phase based on a current engine operating state taken by an engine, to control the variable operation angle mechanism based on the calculated target valve operation angle, and to correct the target rotating phase also based on the calculated target valve operation angle, thereby controlling the variable valve timing mechanism based on the corrected target rotating phase.

The other objects and features of this invention will be understood from the ensuing description with reference to the accompanying drawings.

DESCRIPTION OF THE PREFERRED EMBODIMENTS

Figure 1:
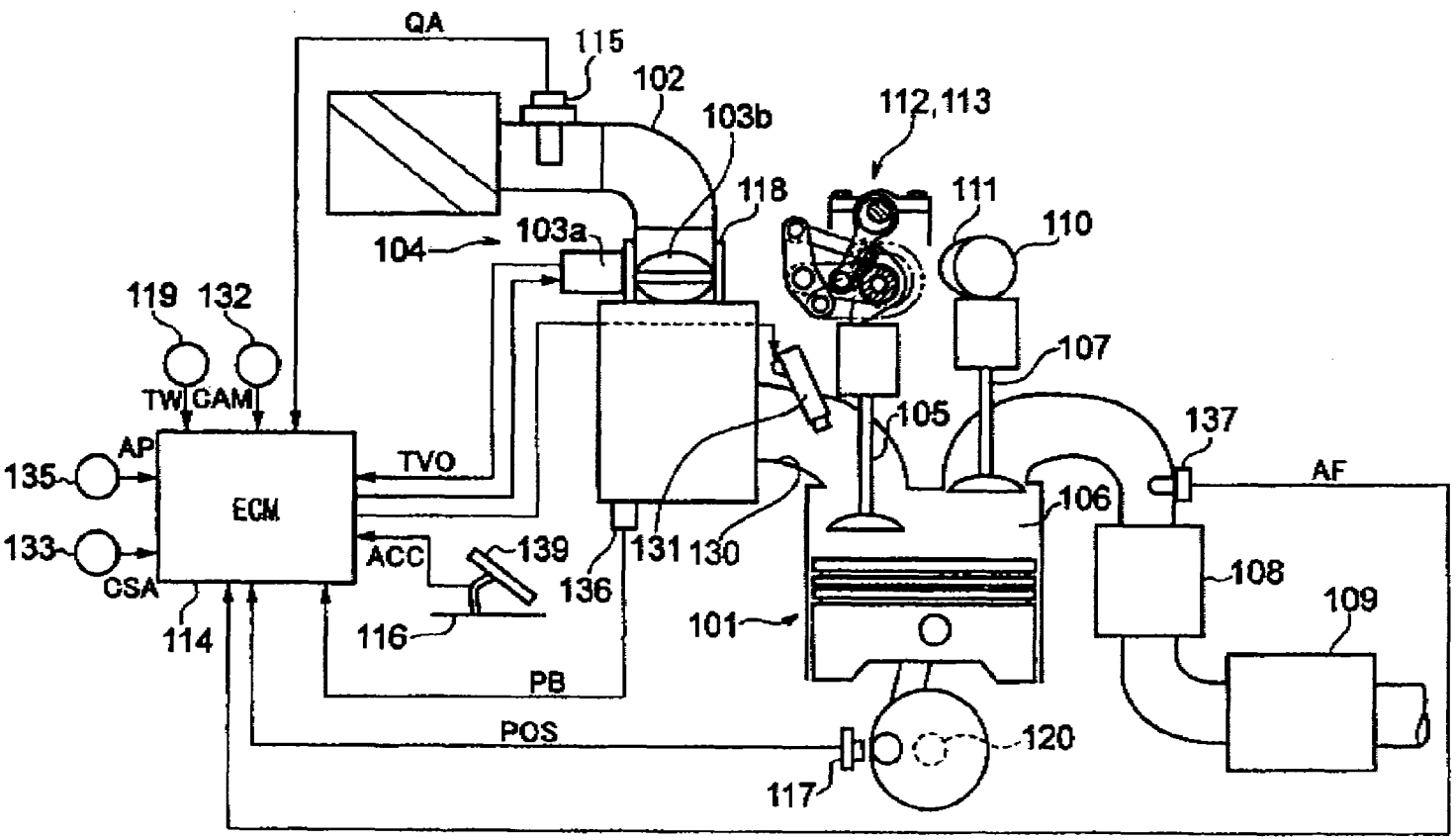
FIG. 1 is a block diagram illustrating a systematic construction of an engine according to an embodiment of the present invention.

FIG. 1 is a block diagram illustrating a systematic construction of a vehicular engine according to the present invention.

Referring to FIG. 1, in an intake pipe 102 of an engine (e.g., an internal combustion engine) 101, there is interposed an electronically controlled throttle 104 in which a throttle motor 103*a* varies an opening degree of a throttle valve 103*b*.

Via electronically controlled throttle 104 and an intake valve 105, suction of the air takes place into a combustion chamber 106.

In an intake port 130 on an upstream side of intake valve 105, a fuel injection valve 131 is provided.

Fuel injection valve 131 injects a fuel of an amount proportional to an injection pulse width of an injection pulse signal provided from an ECM (engine control module) 114.

Then, the fuel in combustion chamber 106 is ignited and combusted by a spark ignition by a not-shown spark plug.

The engine may be an in-cylinder direct injection type engine in which fuel injection valve 131 directly injects fuel into combustion chamber 106, and alternatively the engine may be a compression self-ignition type engine instead of the spark ignition type engine.

Combustion exhaust gas in combustion chamber 106 is discharged via an exhaust valve 107 and is purified in a front catalytic converter 108 and a rear catalytic converter 109, and is then discharged into the atmosphere.

Exhaust valve 107 is driven by a cam 111 disposed on an exhaust camshaft 110, while a valve lift amount, a valve operation angle, and a valve timing are kept constant.

On the other hand, a lift characteristic of intake valve 105 is varied by a VEL (variable operation angle mechanism) 112 and a TVC (variable valve timing mechanism) 113.

VEL 112 is a mechanism that continuously varies the valve operation angle of intake valve 105 together with the valve lift amount thereof, namely, if the valve operation angle is increased, the valve lift amount is also increased in response to the increase in the valve operation angle, at the same time.

VTC 113 is a mechanism that varies a rotating phase of an intake camshaft 13 relative to a crankshaft 120, to thereby continuously vary a phase of the valve operation angle of intake valve 105 relative to crankshaft 120.

ECM 114 having a built-in micro computer sets a fuel injection amount (injection pulse width), an ignition timing, a target intake air amount, a target intake pipe negative pressure, and the like by performing computation processes according to a previously-stored program, and ECM 114 outputs control signals to fuel injection valve 131, a power transistor for a spark coil (not shown in the figures), electronically controlled throttle 104, VEL 112, VTC 113, and the like, based on these set values.

ECM 114 receives detection signals from a various kinds of sensors.

As the various sensors, there are disposed an air flow sensor 115 that detects an intake air amount QA of engine 101, an accelerator pedal sensor 116 that detects an opening degree ACC of an accelerator pedal 139 operated by a driver of a vehicle, a crank angle sensor 117 that outputs a unit crank angle signal POS at each unit crank angle, a throttle sensor 118 that detects an opening degree TVO of throttle valve 103*b*, a water temperature sensor 119 that detects a cooling water temperature TW of engine 101, a cam sensor 132 that outputs a cam signal CAM at each reference position of intake camshaft 13, an angle sensor 133 that detects a rotating angle CSA of a control shaft 30 constituting VEL 112, an atmospheric pressure sensor 135 that detects an atmospheric pressure AP, an intake pressure sensor 136 that detects an intake pressure PB on the downstream of throttle valve 103*b*, an air-fuel ratio sensor 137 that is disposed on the upstream side of front catalytic converter 108 and detects an air-fuel ratio AF based on an oxygen concentration of an exhaust gas, and the like.

Unit crank angle signal POS is set so that a few, for example, one or two, lacks of unit crank angle signal POS occur at every crank angle corresponding to the ignition timing among cylinders. The lacking position of unit crank angle signal POS is detected according to an output cycle of unit crank angle signal POS, and a reference crank angle position REF is detected based on the lacking position.

Based on a phase difference between cam signal CAM output from cam sensor 132 and reference crank angle position REF, an advance amount of the valve timing operated by VTC 113 is detected.

Furthermore, a rotating speed NE of engine 101 is calculated based on a detection cycle of reference crank angle position REF or the number of generated unit crank angle signal POS per unit time.

Next, the structure of VEL 112 will be described in detail with reference to FIGS. 2 through 6.

VEL 112 is provided with: a pair of intake valves 105, 105 slidably disposed on a cylinder head 11; a hollow intake camshaft 13 rotatably supported on the top of cylinder head 11; a drive cam 15 secured to intake camshaft 13 by press-fitting or the like; a pair of oscillating cams 17, 17 disposed coaxially with drive cam 15 and actuates each of intake valves 105, 105 to open via valve lifters 16, 16; rocker arm 18, one end section 18*a* of which is linked to drive cam 15 via a link arm 19 and the other end section 18*b* of which is linked to oscillating cams 17, 17 via a link member 20; a support arm 21, a base end section 21*a* of which is rotatably supported on intake camshaft 13 and a tip end section 21*b* of which is coupled to a swing support of rocker arm 18; and drive means 22 that tilts support arm 21 for an angle within a predetermined angle range.

To intake camshaft 13, a rotating force is transmitted from crankshaft 120 via a cam sprocket disposed on one end section of intake camshaft 13 and a timing chain wounded around the cam sprocket.

Figure 4:
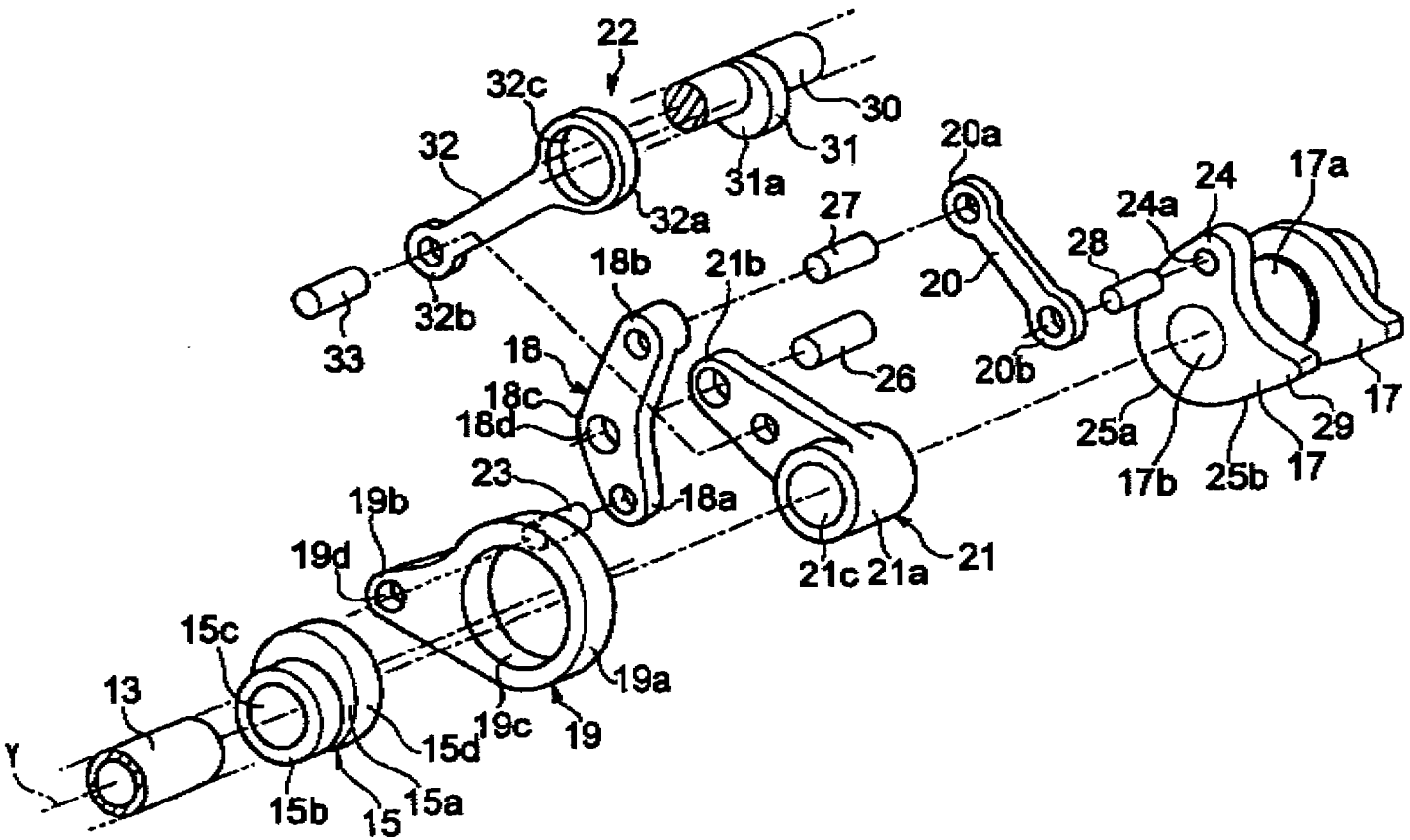
FIG. 4 is an exploded perspective view illustrating the variable operation angle mechanism according to the embodiment of the present invention.

As shown in FIG. 4, drive cam 15 includes a cam main body 15*a* and a cylindrical portion 15*b* that is integrally provided on one outer end face of cam main body 15*a*. An axial shaft insertion hole 15*c* is internally formed in drive cam 15, and the central axis "X" of cam main body 15*a* is decentered by a predetermined amount from the central axis "Y" of intake camshaft 13.

Furthermore, drive cam 15 is fixed to intake camshaft 13 by press-fitting, via shaft insertion hole 15*c*.

Link arm 19 is provided with a base section 19*a* and a protruding end 19*b* that is provided so as to protrude on the outer circumferential face of base section 19*a*. In the center position of base section 19*a* there is formed a fitting hole 19*c* that rotatably fits with the outer circumferential face of cam main body 15*a* of drive cam 15, and in protruding end 19*b* there is through-formed a pin hole 19*d* through which pin 23 for linking rocker arm 18 is rotatably inserted thereby.

Figure 3:
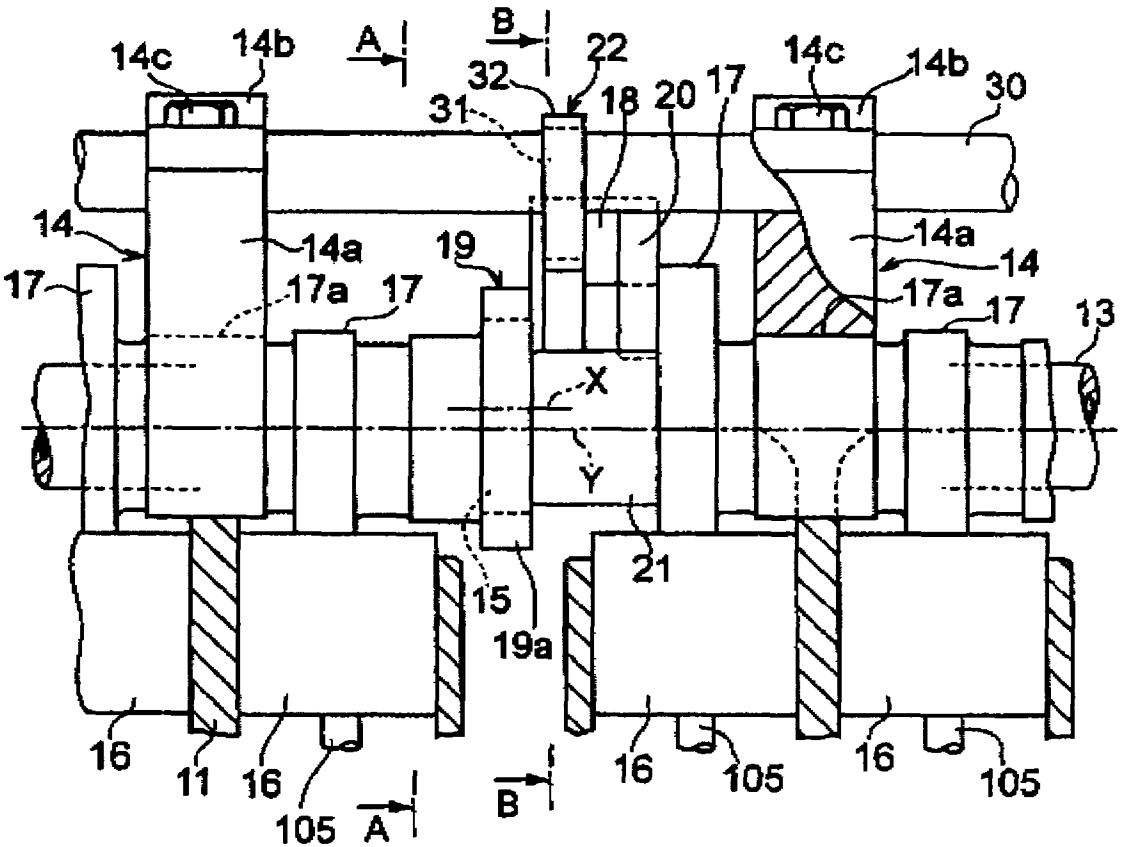
FIG. 3 is a side view illustrating the variable operation angle mechanism according to the embodiment of the present invention.

As shown in FIGS. 3 and 4, oscillating cams 17, 17 are disposed on both ends of a cylindrical base section 17*a*, in which there is through-formed a supporting hole 17*b* through which intake camshaft 13 is insert-fitted and rotatably supported.

In an end section 24 of one of oscillating cams 17, there is through-formed a pin hole 24*a*.

Moreover, on the under face of each of oscillating cams 17, 17, there are formed a base circular face 25*a* and a cam face 25*b* that extends in an arc shape from base circular face 25*a* towards an end section 29 side. Base circular face 25*a* and cam face 25*b* are to come in contact with predetermined positions on the top face of each of valve lifters 19 according to the oscillating position of oscillating cam 17.

A rotating direction of oscillating cams 17, 17 during a curve indicating lift-rise and extending from base circular face 25*a* to the end edge of cam face 25*b* is set to a direction opposite to a rotating direction of intake camshaft 13.

A bearing 14 includes a main bracket 14*a* that supports base section 17*a* positioned between oscillating cams 17, 17, and a sub bracket 14*b* that rotatably supports control shaft 30 described later, and both brackets 14*a* and 14*b* are fastened to be fixed together from above by a pair of bolts 14*c*, 14*c*.

As shown in FIG. 4, rocker arm 18 is arranged such that a central base section 18*c* is rotatably coupled to tip end section 21*b* of support arm 21 via a pin 26, one end section 18*a* is rotatably coupled to protruding end 19*b* of link arm 19 via pin 23, and the other end section 18*b* is rotatably coupled to one end section 20*a* of link member 20 via a pin 27.

As shown in FIG. 4, both end sections 20*a* and 20*b* of link member 20 are rotatably coupled to the other end section 18*b* of rocker arm 18 and end section 24 of oscillating cam 17, via pins 27 and 28, respectively.

Figure 2:
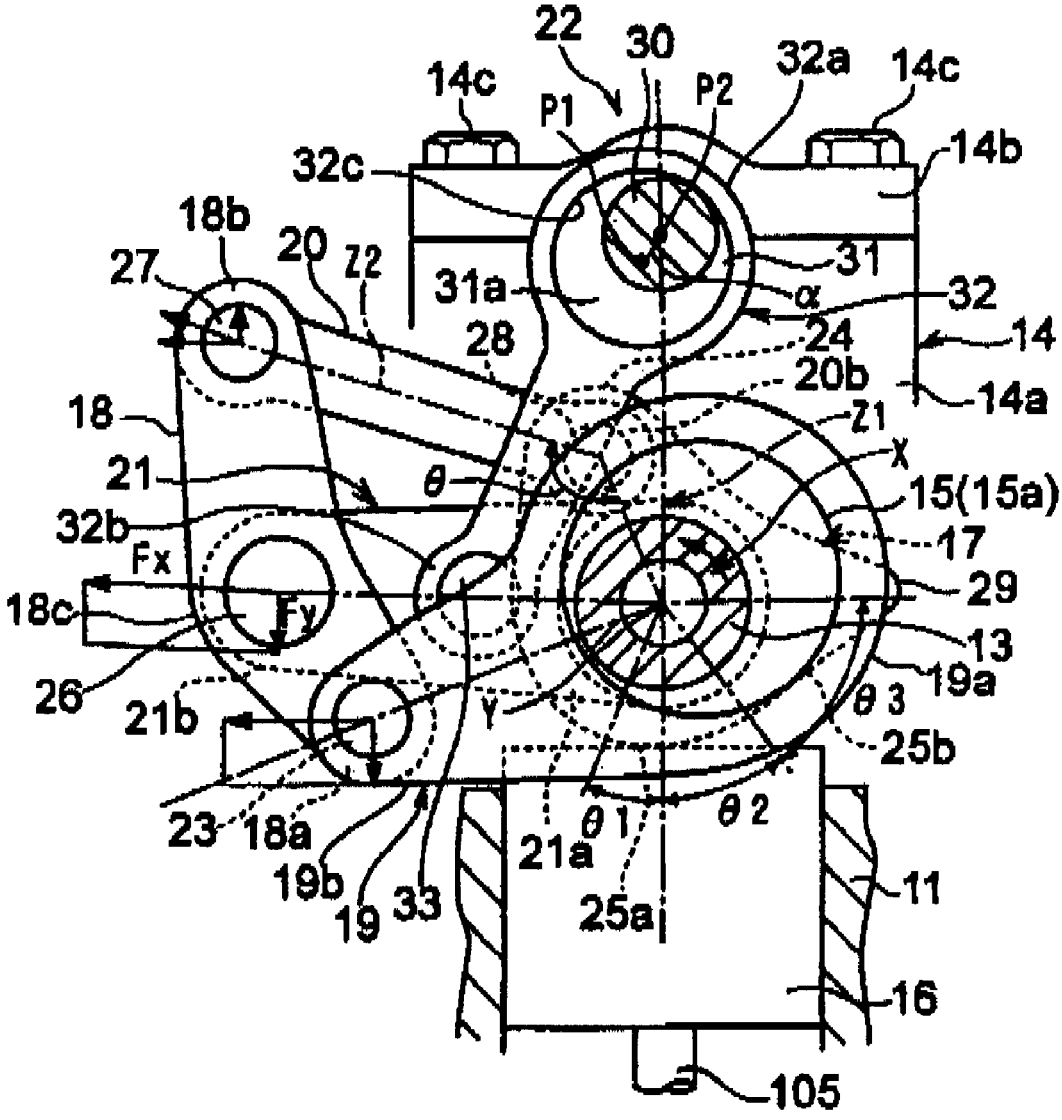
FIG. 2 is a cross sectional view illustrating a variable operation angle mechanism according to the embodiment of the present invention.

Moreover, as shown in FIG. 2, a line Z1 extending from the rotation center point of oscillating cam 17 to the center point of the coupling of oscillating cam 17 and link member 20, and a line Z2 extending from the coupling center point and extending along the central axis of link member 20, are arranged to meet at a predetermined angle θ.

As shown in FIGS. 2 and 4, support arm 21 is arranged such that base end section 21*a* is rotatably supported on the outer circumferential face of intake camshaft 13 via shaft insertion hole 21*c* formed in base end section 21*a*, and tip end section 21*b* is coupled to pin hole 18*d* of base section 18*c* of rocker arm 18 via pin 26, as described above, to thereby serve as the swing support of rocker arm 18.

Moreover, support arm 21 is arranged in a manner that base end section 21*a* is held between drive cam 15 and oscillating cam 17.

Furthermore, support arm 21 is configured to rotate upward and downward by drive means 22, to thereby vary the valve lift amount of intake valves 105, 105, and is set so that when the valve lift amount is controlled to decrease, the rotating direction of the support arm 21 rotates downward in the direction same as the rotating direction of intake camshaft 13, as indicated by an arrow in the figure.

Drive means 22 comprises control shaft 30 that is rotatably borne between main bracket 14*a* and sub bracket 14*b* of bearing 14, a control cam 31 that is integrally secured on the outer circumference of control shaft 30, a control link 32 by which control cam 31 and support arm 21 are linked to each other, and a not-shown actuator that rotation-drives control shaft 30.

As the actuator, an electric motor, for example, may be employed.

Each control cam 31 is secured on the outer circumference of control shaft 30, and as shown in FIG. 2, a central axis P1 of control cam 31 is shifted from a central axis P of control shaft 30 by α.

Moreover, control link 32 is configured that one end section 32*a* thereof is rotatably supported on the outer circumferential face of control cam 31 via a circular hole 32*a*, and the other end section 32*b* thereof is rotatably coupled to support arm 21 on a substantially center position in the longitudinal direction of support arm 21 via a pin 33.

A rotating range of control shaft 30 is limited by a stopper so that the stopper permits control shaft 30 to rotate within an angle range from an angle position corresponding to a minimum valve lift amount/minimum valve operation angle (default angle) to an angle position corresponding to a maximum valve lift amount/maximum valve operation angle. Control shaft 30 is rotation-driven within the rotating range by the actuator, which is operated in response to a control signal provided from ECM 114.

In the followings, the operation of VEL 112 having the above described structure will be described.

First, to decrease the valve lift amount of intake valve 105, the angle position of control shaft 30 is controlled so that central axis P1 of control cam 31 is positioned on the lower left side of central axis P2 of control shaft 30 and a thick-walled part 31*a* approaches intake camshaft 13, as shown in FIG. 2.

At this time, support arm 21 downwardly rotates around base end section 21*a* and is maintained at a substantially horizontal position, as shown in the same figure.

Consequently, rocker arm 18 moves downward as a whole, and end section 24 of each oscillating cam 17 is forcibly pulled up slightly via link member 20, so that oscillating cam 17 rotates leftward (counterclockwise) as a whole.

When one end section 18*a* of rocker arm 18 is pushed up or down via link arm 19 by a rotating movement of drive can 15, rocker arm 18 swings about tip end section 21*b* of support arm 21 as a swing support. The swing force is transmitted from the other end section 18*b* to oscillating cam 17 and valve lifter 16 via link member 20, so that a lift amount L1 becomes relatively small as shown in FIG. 5.

Figure 7:
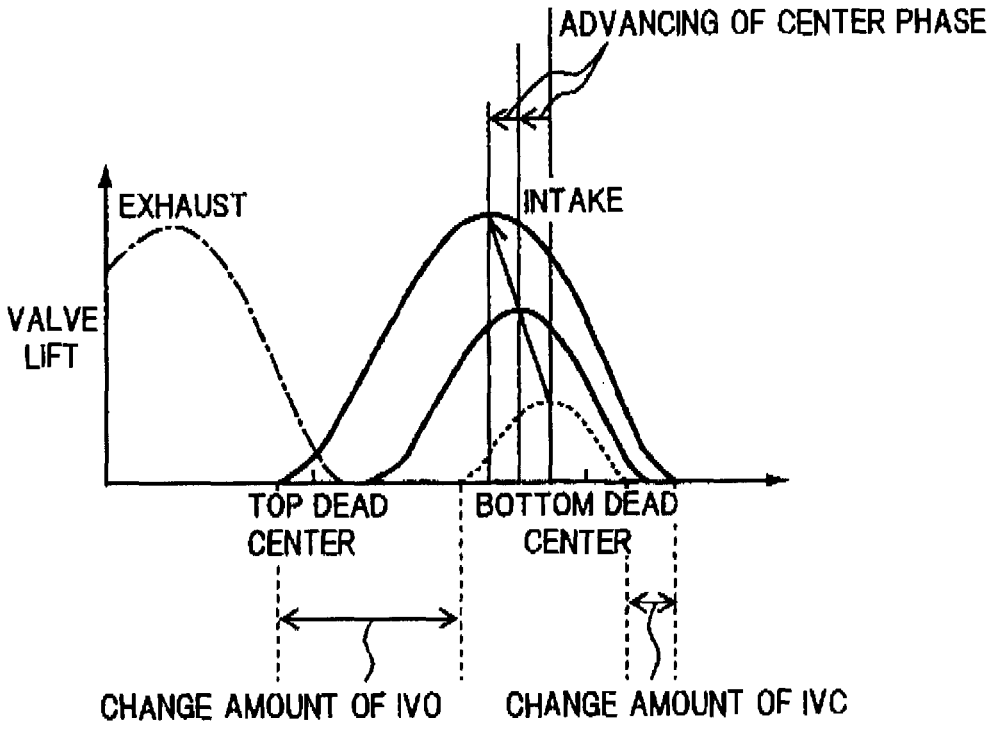
FIG. 7 is a graphical view illustrating variation characteristics of a valve operation angle and a valve lift amount of the variable operation angle mechanism according to the embodiment of the present invention.

Thus, as shown in FIG. 7, when the valve lift amount and the valve operation angle are decreased, the phase of the center angle position of the valve operation angle relative to crankshaft 120 thereof (i.e., center phase) varies in a retard direction compared with that of when the valve lift amount and the valve operation angle are larger.

Figure 5:
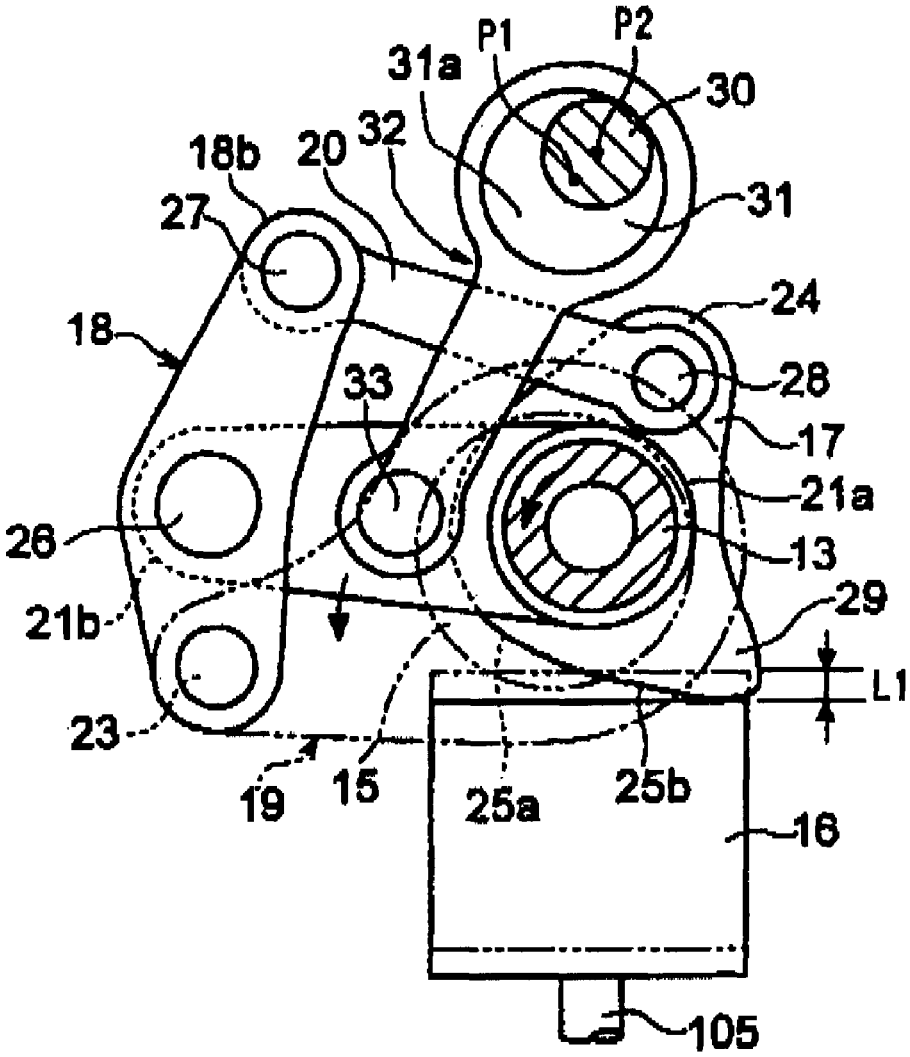
FIG. 5 is a cross sectional view illustrating the variable operation angle mechanism according to the embodiment of the present invention, staying at its state of low lift.
Figure 6A:
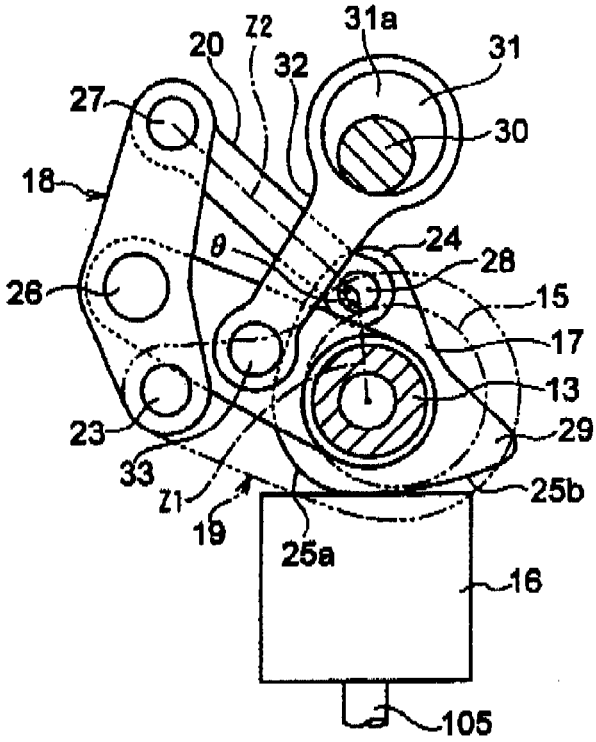
FIG. 6 is a cross sectional view illustrating the same variable operation angle mechanism, staying at its state of high lift.
Figure 6B:
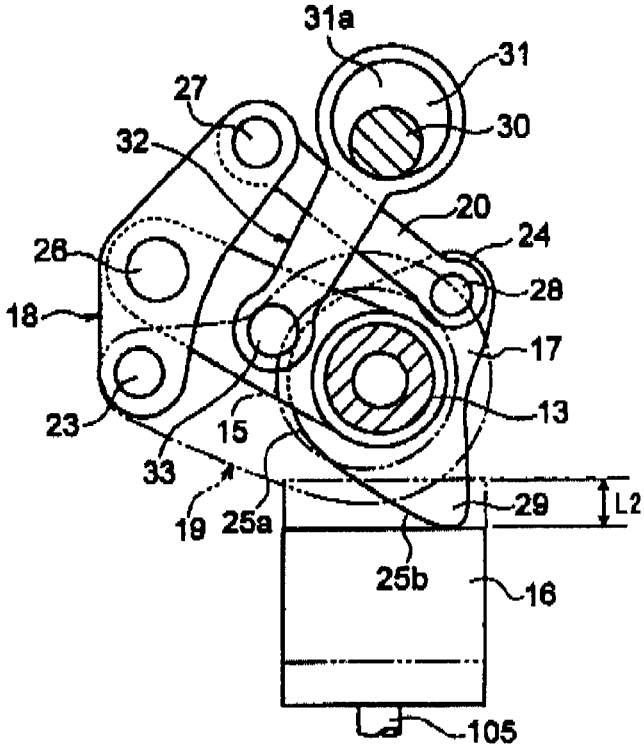

In contrast, to increase the valve lift amount and the valve operation angle, control shaft 30 is rotation-driven so that control cam 31 is rotated clockwise by approximately 180° from the position indicated in FIGS. 2 and 5 and central axis P1 (thick-walled part 31*a*) is moved upward, as shown in FIGS. 6A and 6B.

At this time, support arm 21 upwardly rotates around base end section 21*a* and is maintained at a rotated position with a predetermined angle. Rocker arm 18 moves upward as a whole, and the other end section 18*b* of rocker arm 18 presses upper end section 24 of oscillating cam 17 in a rightward direction in the illustration of FIG. 2 via link member 20, so that oscillating cam 17 rotates clockwise by a predetermined degree as a whole.

Thus, as shown in FIG. 6A, cam face 25*b* of oscillating cam 17 comes in contact with a top face of valve lifter 16, and when one end section 18*a* of rocker arm 18 is pushed up via link arm 19, a lift amount L2 becomes larger, as shown in FIG. 6B.

Namely, as shown in FIG. 7, when the valve lift amount and the valve operation angle are larger, the phase of the center angle position of the valve operation angle relative to crankshaft 120 thereof (i.e., center phase) varies in an advance direction compared with that of when the valve lift amount and the valve operation angle are smaller.

As mentioned above, in VEL 112, to decrease the valve lift amount and the valve operation angle, support arm 21 is rotated from the upper rotated position as shown in FIGS. 6A and 6B to the horizontal rotated position as shown in FIGS. 2 and 5. This rotating direction is the same as the rotating direction of intake camshaft 13 and is the direction opposite to the rotating direction of the lift-rise of oscillating cam 17. Accordingly, the center phase of the valve operation angle of intake valves 105, 105 is retarded as shown in FIG. 7.

Thus, to decrease the valve lift amount and the valve operation angle, support arm 21 is rotated downward by the downwardly rotating movement of control cam 31, as described above. At this time, driving cam 15 also rotates in the same direction. Thus a time required for operating from a position after the top dead center to a position where the lifting starts becomes longer, and accordingly, a swing start timing of rocker arm 18 is also delayed.

On the other hand, since the rotating direction of support arm 21 is set to be opposite to the rotating direction of oscillating cam 17 during the lift-rise, a delay in the lift-rising timing of oscillating cam 17 occurs due to the delay in the swing start timing of rocker arm 18. Consequently, when the valve lift amount and the valve operation angle are decreased, the center phase of the valve operation angle is retarded, as shown in FIG. 7.

In the present embodiment, the center phase of the valve operation angle has characteristics that the center phase is retarded when the valve lift amount and the valve operation angle is changed to be smaller. However, the center phase may have characteristics that the center phase is advanced, contrary to the present embodiment.

Figure 8:
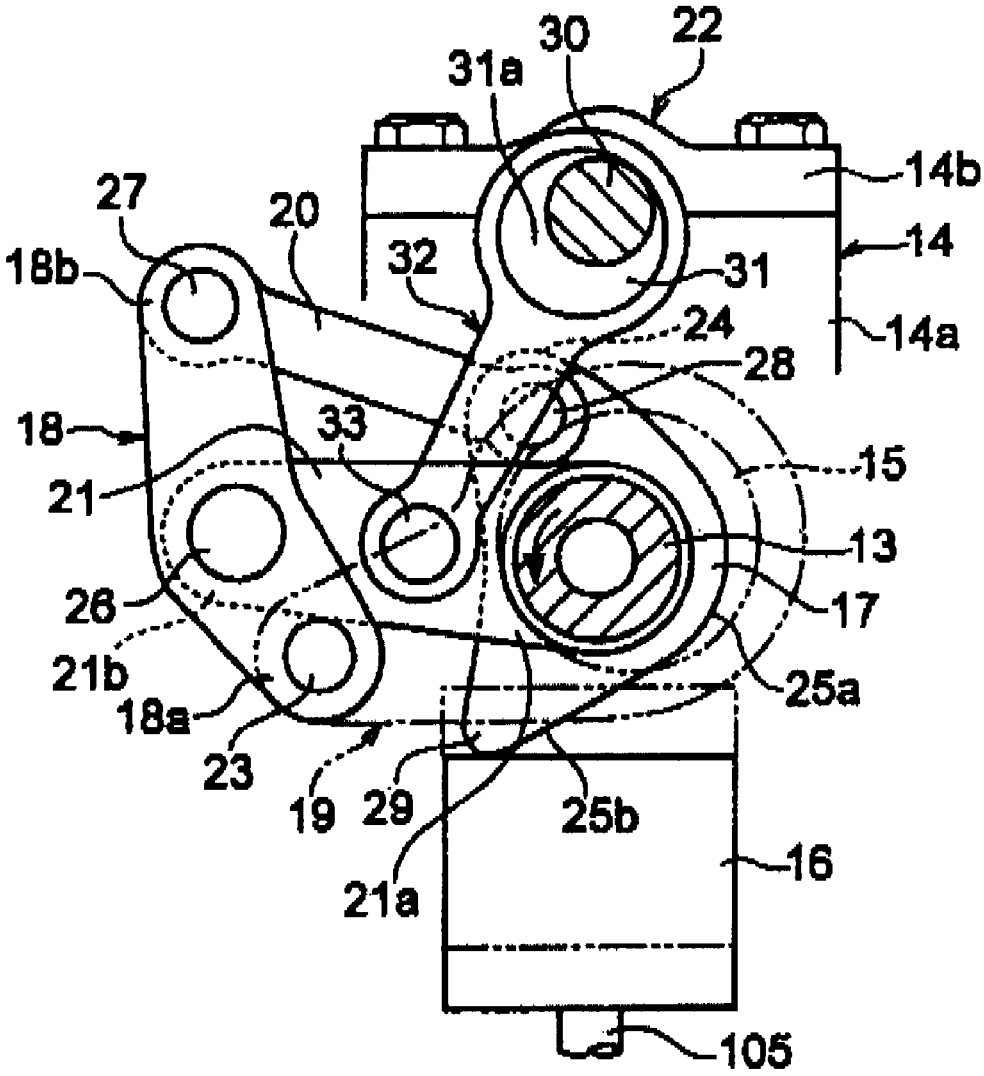
FIG. 8 is a cross sectional view illustrating a variable operation angle mechanism according to the embodiment of the present invention, which mechanism differs from that illustrated in FIGS. 2 through 6 in variation characteristics of the valve operation angle and the valve lift amount.

FIG. 8 shows a structure of VEL 112 in which the variation characteristics of the center phase in response to the variation in the valve lift amount and the valve operation angle, is opposite to that in the mechanism shown in FIGS. 2 through 6.

The structure of VEL 112 shown in FIG. 8 is basically the same as that shown in FIGS. 2 through 6, except that the rotating direction of support arm 21 relative to the rotating direction of intake camshaft 13 is set to be opposite to the direction set in the mechanism of FIGS. 2 through 6 when the valve lift amount and the valve operation angle are decreased, and that oscillating cam 17 is reversely arranged so that the rotating direction of oscillating cam 17 during the lift-rise is the same as the rotating direction of intake camshaft 13.

Namely, the rotating direction of oscillating cam 17 during the lift-rise in VEL shown in FIG. 8 is set to be opposite to the rotating direction of support arm 21.

Thus, to decrease valve lift amount and the valve operation angle, support arm 21 is rotate upward by drive means 22, so that rocker arm 18 also moves upward. At this time, since drive cam 15 rotates in a direction opposite to this movement, a rocking timing of rocker arm 18 becomes earlier.

Figure 9:
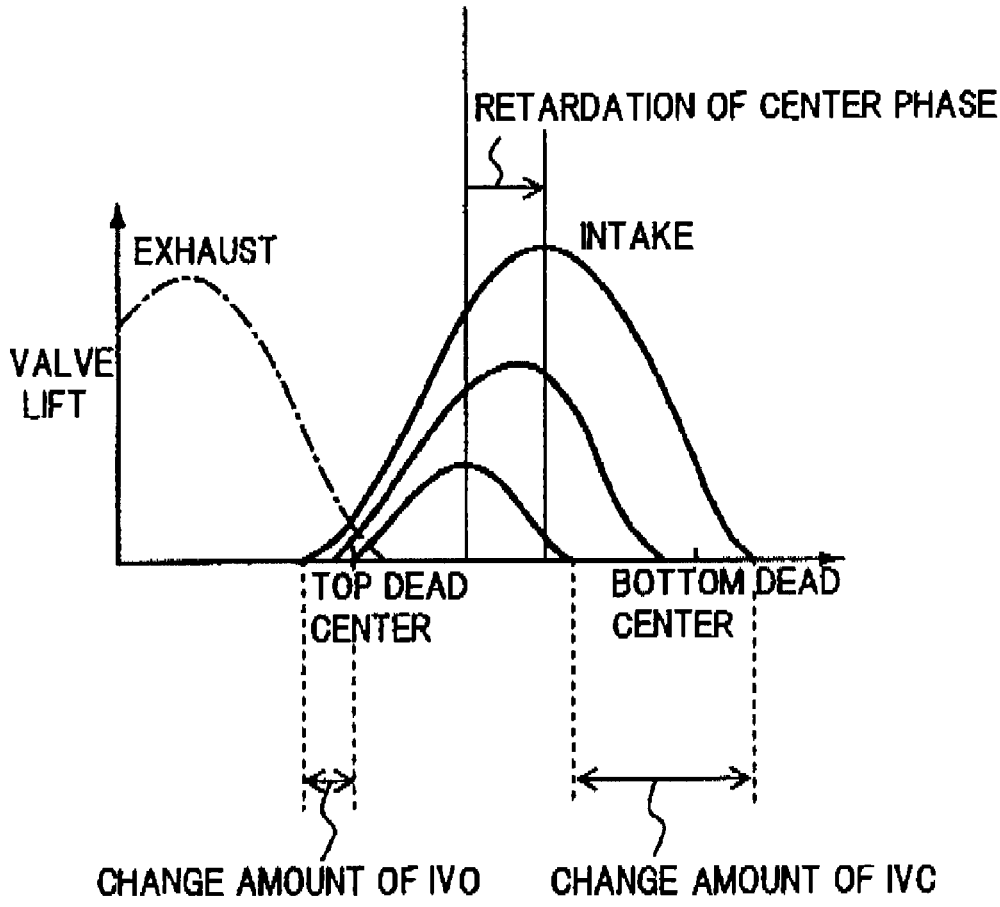
FIG. 9 is a graphical view illustrating variation characteristics of the valve operation angle and the valve lift amount of the variable operation angle mechanism illustrated in FIG. 8.

Consequently, the rotating movement of oscillating cam 17 in a lift-rising direction becomes earlier, and accordingly, if the valve lift amount and valve operation angle are decreased, the center phase of the valve operation angle is advanced at the same time, as shown in FIG. 9.

ECM 114 receives a detection signal provided from angle sensor 133 that detects the rotating angle of control cam 30, and in order to rotate control shaft 30 to a target angle position corresponding to a target valve operation angle/target valve lift amount, ECM 133 feedback controls a manipulated variable of the actuator that rotates control shaft 30 based on the detection result of angle sensor 133.

Figure 10:
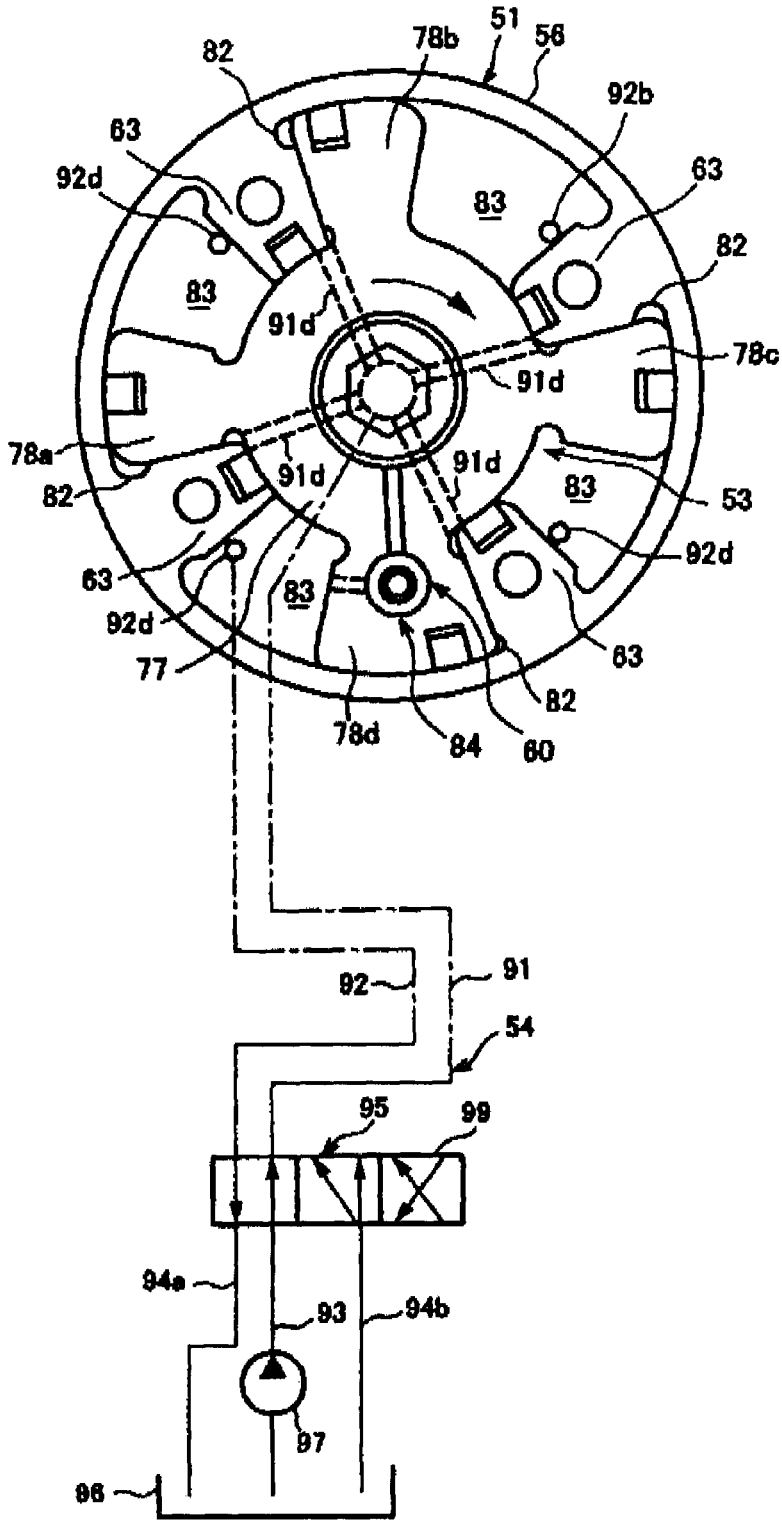
FIG. 10 is a cross sectional view illustrating a variable valve timing mechanism according to an embodiment of the present invention.

Next, the structure of VTC 113 will be described with reference to FIG. 10.

Although a vane-type variable valve timing mechanism is employed as VTC 113 in the present embodiment, VTC 113 is not limited to the vane-type mechanism, and various known mechanisms, such as an electric mechanism and a mechanism using an electromagnetic retarder, may be adopted.

Vane-type VTC 113 is provided with a cam sprocket 51 that is rotation-driven by crank shaft 120 via a timing chain, a rotation member 53 that is fixed on the end section of intake camshaft 13 and rotatably housed within cam sprocket 51, a hydraulic circuit 54 that relatively rotates rotation member 53 with respect to cam sprocket 51, and a locking mechanism 60 that selectively locks the relative rotational position between cam sprocket 51 and rotation member 53 in a predetermined position.

Cam sprocket 51 comprises: a rotating section (not shown in the figure) having a teeth section on the outer circumference thereof, with which the timing chain meshes; a housing 56 that is disposed in front of the rotating section so as to rotatably house rotation member 53; and a front cover and a rear cover (not shown in the figure) that block front/rear openings of housing 56.

Housing 56 is of a cylindrical shape, with both of the front/rear ends formed open ended, and on the inner circumferential face of housing 56 there are provided four protruding partition wall sections 63 in sectionally trapezoid shape along the circumferential direction of housing 56 at equal intervals of 90°.

Rotation member 53 is fixed to the front end section of intake camshaft 13 and is provided with four vanes 78*a*, 78*b*, 78*c*, 78*d* formed therein at equal intervals of 90° on the outer circumferential face of an annularly extended base section 77.

First to fourth vanes 78*a* to 78*d* are respectively of substantially sectionally inverse trapezoid shape and are disposed in cavity sections between respective partition wall sections 63, and they partition these cavity sections in front and rear thereof in the rotating direction. Thereby, between both sides of vanes 78*a* to 78*d* and both end faces of the respective partition wall sections 63, there are formed an advance angle side hydraulic pressure chamber 82 and a retard angle side hydraulic pressure chamber 83.

Locking mechanism 60 is configured such that a lock pin 84 is insert-fitted into an engaging hole (not shown in the figure) in a rotating position on the maximum retard angle side of rotation member 53 (in a default position).

Hydraulic circuit 54 has two systems of oil pressure passages, namely a first oil pressure passage 91 that supplies and discharges oil pressure to advance angle side hydraulic pressure chamber 82 and a second oil pressure passage 92 that supplies and discharges oil pressure to retard angle side hydraulic pressure chamber 83, and to both of these oil pressure passages 91 and 92, there are connected a supply passage 93 and drain passages 94*a* and 94*b* respectively via an electromagnetic switching valve 95 for switching the passages.

In supply passage 93, there is provided an engine-driven oil pump 97 that pressure feeds the oil inside an oil pan 96, while the downstream side ends of drain passages 94*a* and 94*b* are communicated with oil pan 96.

First oil pressure passage 91 is connected to four branched passages 91*d* that are formed in a substantially radial pattern in base section 77 of rotation member 53 so as to communicate with the respective advance angle side hydraulic pressure chambers 82, and second oil pressure passage 92 is connected to four oil holes 92*d* that open to respective retard angle side hydraulic pressure chambers 83.

Electromagnetic switching valve 95 is configured such that a spool valve therein carries out relative switching control between respective oil pressure passages 91 and 92, supply passage 93, and drain passages 94*a* and 94*b*.

ECM 114 controls a current flow amount to an electromagnetic actuator 99 that drives electromagnetic switching valve 95, based on a duty control signal.

For example, when a control signal of a duty ratio of 0% (OFF signal) is output to electromagnetic actuator 99, the operating oil that has been pressure-fed from oil pump 97 travels through second oil pressure passage 92 to be supplied into retard angle side hydraulic pressure chamber 83, and the operating oil within advance angle side hydraulic pressure chamber 82 travels through first oil pressure passage 91 to be discharged from first drain passage 94*a* into oil pan 96.

Consequently, the internal pressure of retard angle side hydraulic pressure chamber 83 becomes high and the internal pressure of advance angle side hydraulic pressure chamber 82 becomes low, and rotation member 53 rotates towards the retard angle side via vanes 78*a* to 78*d*. As a result, the phase of the opening timing of intake valve 105 relative to crankshaft 120 is retarded.

On the other hand, when a control signal of a duty ratio of 100% (ON signal) is output to electromagnetic actuator 99, the operating oil travels through first oil pressure passage 91 so as to be supplied into advance angle side hydraulic pressure chamber 82, and the operating oil within retard angle side hydraulic pressure chamber 83 travels through second oil pressure passage 92 and second drain passage 94*b* so as to be discharged into oil pan 96, thereby reducing the pressure of retard angle side hydraulic pressure chamber 83.

Therefore, rotation member 53 rotates towards the advance angle side via vanes 78*a* to 78*d*, thereby advancing the phase of the opening timing of intake valve 105 relative to crankshaft 120.

Thus, within a range where vanes 78*a* to 78*d* can relatively rotate in housing 56, the phase of intake camshaft 13 relative to crankshaft 120 continuously shifts between the most retarded position and the most advanced position, and the phase of the opening timing of intake valve 105 continuously shifts.

In the followings, the control operation of VEL 112 and VTC 113 carded out by ECM 114 will be described in detail, with reference to the flowchart shown in FIG. 11.

Figure 11:
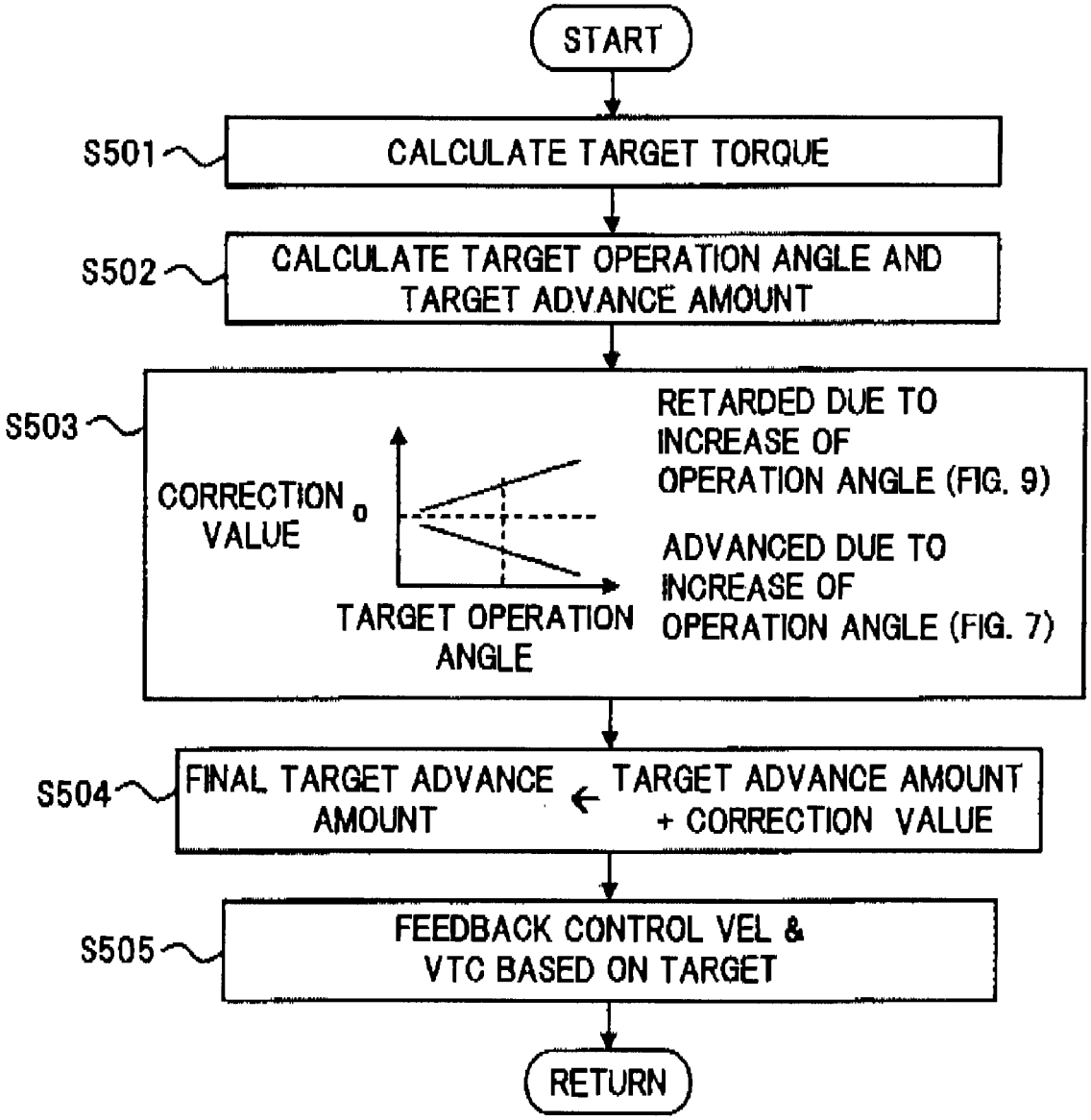
FIG. 11 is a flowchart illustrating a correction control of a target value of the variable valve timing mechanism according to the embodiment of the present invention.

A routine indicated in the flowchart of FIG. 11 is executed at every given fixed cycle (e.g., 10 microseconds each).

In step S501, a target torque is calculated based on both accelerator opening degree ACC detected by accelerator pedal sensor 116 and engine rotating speed NE calculated based on the signal from crank angle sensor 117.

Figure 12:
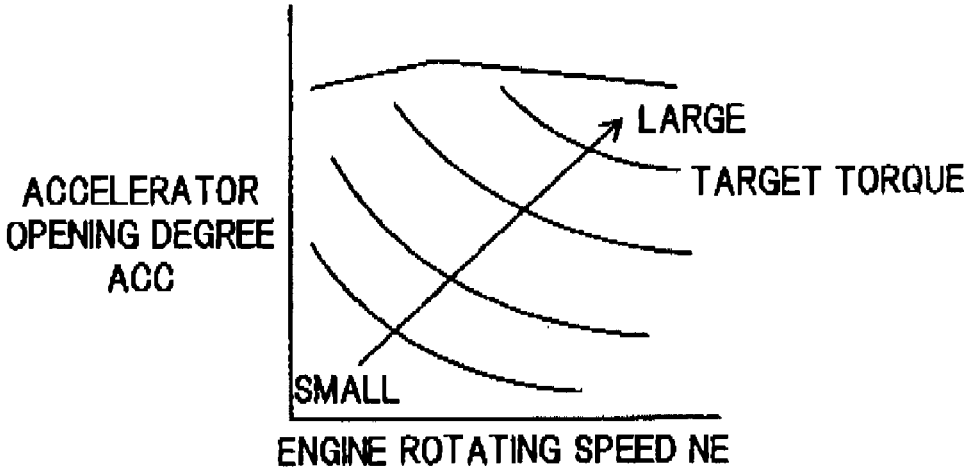
FIG. 12 is a graphical view illustrating a correlation between an accelerator opening degree ACC, an engine rotating speed NE, and a target torque according to the embodiment of the present invention.

As shown in FIG. 12, the target torque is calculated by making reference to a previously-provided map, in which there is previously stored the target torque employing accelerator opening degree ACC and engine rotating speed NE as variables.

Here, the target torque is set so that the larger accelerator opening degree ACC is or the greater engine rotating speed NE is, the larger target torque is calculated.

In the next step S502, each of a target value of the valve operation angle (target operation angle) that is varied by VEL 112 and a target advance amount in VTC 113 is calculated from the target torque and engine rotating speed NE.

Here, the target advance amount is expressed as an advance angle from the most retarded position which is a reference position (default position), and the target operation angle is calculated as a rotating angle from a reference angle (default angle) of control shaft 30 that corresponds to the minimum valve operation angle.

Figure 13:
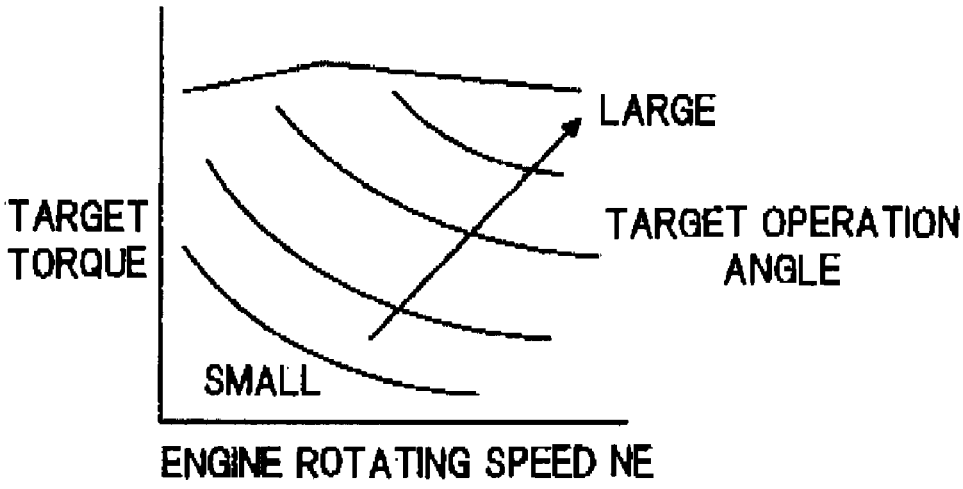
FIG. 13 is a graphical view illustrating a correlation between the target torque, the engine rotating speed NE, and a target value of the variable operation angle mechanism according to the embodiment of the present invention.

As shown in FIG. 13, there is provided a map which previously stores the target operation angle by employing the target torque and engine rotating speed NE as variables and thus, a given target operation angle is calculated by making reference to the previously-provided map. Here, it should be understood that the larger the target torque is or the greater engine rotating speed NE is, the larger target operation angle is calculated.

Figure 14:
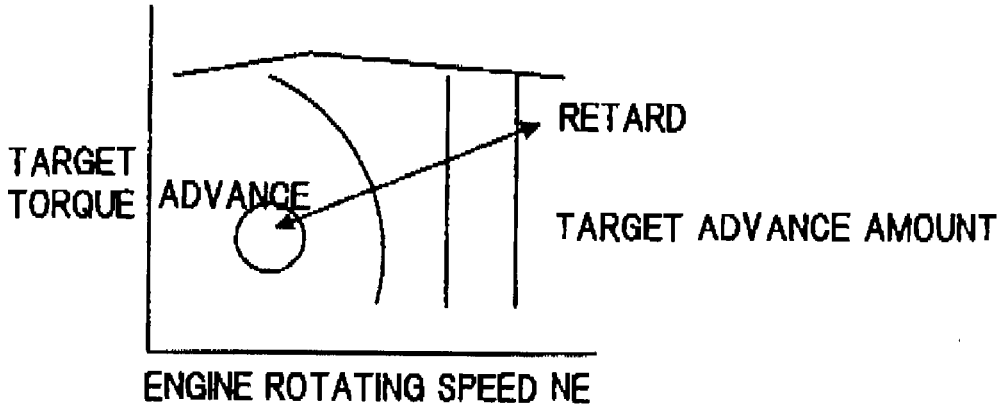
FIG. 14 is a graphical view illustrating a correlation between the target torque, the engine rotating speed NE, and the target value of the variable valve timing mechanism according to the embodiment of the present invention.

Moreover, as shown in FIG. 14, there is provided a map which previously stores the target advance amount by employing the target torque and engine rotating speed NE as variables and thus, a given target advance amount is calculated by making reference to the previously-provided map. Here, as shown in FIG. 14, in a region where the engine rotation is low, the target advance amount is set to the most advanced value in a reference operation region which is near the center of the low rotation region, and as separating from the reference operation region, the target advance amount is more retarded. Furthermore, in the high rotation region, the target advance amount is set to a value in a more retard angle side than that in the low rotation region, and as engine rotating speed NE gets higher, the target advance amount is retarded.

The target operation angle and target advance amount, however, may be set based on any engine operating state, and not limited to the configuration in which the target operation angle and target advance amount are set based on the target torque and engine rotating speed NE.

The target advance amount is calculated as a target of the center phase of the valve operation angle of intake valve 105.

However, VEL 112 employed in the present embodiment is a mechanism in which the center phase of the valve operation angle varies in response to an increase/decrease in the valve operation angle, as described above. Accordingly, even if VTC 113 is controlled to the most retarded position, an actual center phase will differ from the target center phase depending on the valve operation angle at that time, for example.

Thus, in the next step S503, a correction value for correcting the target advance amount based on a change amount of the center phase caused by the variation in the valve operation angle varied by VEL 112.

Specifically, there is previously provided a table in which the correction value according to the target operation angle is stored, and in step S503, the correction value corresponding to the target operation angle at that time is retrieved from the table.

Here, as shown in FIG. 7, if there is employed VEL 112 which retards the center phase in response to the decrease in the valve operation angle, the center phase is advanced as the valve operation angle increases, when using a center phase of the minimum valve operation angle as a basis.

Figure 15:
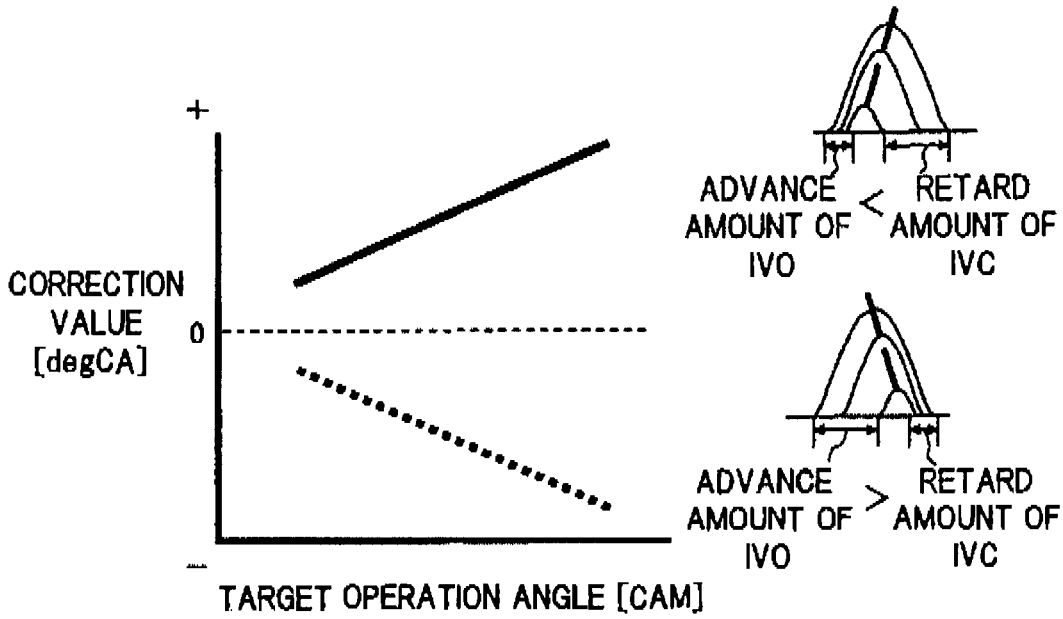
FIG. 15 is a graphical view illustrating a correlation between the target value of the variable operation angle mechanism and a correction value for correcting the target value of the variable valve timing mechanism according to the embodiment of the present invention.

Then, in order to cancel out the advancing change of a center phase due to the increase in the valve operation angle so as to conform the center phase of the increased valve operation angle to a center phase of the minimum operation angle, the correction value is set, as shown in FIG. 15 by a dotted line, to a value that: is a negative number, an absolute value of which increases as the target operation angle increases; and corrects the target advance amount in the retard direction to a greater degree as the target operation angle increases.

On the other hand, as shown in FIG. 9, if there is employed VEL 112 which advances the center phase in response to the decrease in the valve operation angle, the center phase is retarded as the valve operation angle increases, when using the center phase of the minimum valve operation angle as a basis.

Thus, in order to cancel out the retarding change of a center phase due to the increase in the valve operation angle so as to conform the center phase of the increased valve operation angle to a center phase of the minimum operation angle, the correction value is set, as shown in FIG. 15 by a solid line, to a value that: is a positive number, an absolute value of which increases as the target operation angle increases; and corrects the target advance amount in the advance direction to a greater degree as the target operation angle increases.

In step S504, the target advance amount set in step S502 is added with the correction value set in step S503, thereby obtaining a final target advance amount.

By controlling VTC 113 based on the final target advance amount corrected with the correction value, even if the target valve operation angle differs, the center phase at that time can be controlled to a center phase required from the target torque and engine rotating speed NE at that time.

In step S505, a manipulated variable of VEL 112 is feedback controlled based on the target operation angle set in step S502, and a manipulated variable of VTC 113 is feedback controlled based on the final target advance amount corrected in step S504.

For these feedback controls, various control techniques, such as a PID control that sets a proportional manipulated variable, an integral manipulated variable and a derivative manipulated variable, a reference model control, a sliding mode control, and the like, may be used based on a difference between a control amount detected by a sensor and a target value.

In a first embodiment indicated in the flowchart shown in FIG. 11, the correction value for correcting the target advance amount is obtained by retrieving from the table based on the target operation angle, however, the correction value may be set by calculating the change amount of the center phase due to the varied valve operation angle from the target operation angle at that time. In the followings, a second embodiment according this configuration will be described with reference to the flowchart shown in FIG. 16.

In steps S601 and S602, a target torque, a target operation angle, and a target advance amount are calculated as with the above steps S501 and S502.

In step S603, a difference between a central phase at the target operation angle at that time and a central phase at a reference operation angle (minimum operation angle), and based on the obtained difference, the correction value is set.

Specifically, an opening timing IVO and a closing timing IVC of intake valve 105 in the target operation angle at that time and in the case where VTC 113 is controlled to a reference advance amount, is calculated in accordance with the following equation:

$$IVO=IVOdef-(OPAtar-OPAdef)\times RIVO$$

$$IVC=IVCdef+(OPAtar-OPAdef)\times(1-RIVO)$$

Here, the opening/closing timings of intake valve 105 are expressed as a retard angle from the top dead center.

In the above equation, OPAtar is a target operation angle, and OPAdef is an operation angle in a default state of VEL 112 (reference operation angle), e.g., a minimum operation angle.

IVOdef is an opening timing IVO in the default state of VEL 112 and VTC 113, namely, in the minimum operation angle and the most retarded position, and IVCdef is a closing timing IVC in the default state of VEL 112 and VTC 113, namely, in the minimum operation angle and the most retarded position. These IVOdef and IVCdef are previously stored.

Furthermore, RIVO represents a ratio of a change angle of opening timing IVO to a change amount of the valve operation angle operated by VEL 112, and RIVC represents a ratio of a change angle of closing timing IVC to a change amount of the valve operation angle operated by VEL 112.

Here, RIVO+RIVC=100%.

For example, in the case where the center phase of valve operation angle does not vary even the valve operation angle is varied by VEL 112, opening timing IVO is advanced for a half of increased angle of the valve operation angle, and closing timing IVC is retarded for the other half of increased angle, and similarly, opening timing IVO is retarded for a half of decreased angle of the valve operation angle, and closing timing IVC is advanced for the other half of decreased angle.

Thus, in the case where the center phase of valve operation angle does not vary even the valve operation angle is varied because opening timing IVO varies for a half of the change angle of the valve operation angle and closing timing IVC varies for the other half of the change angle of the valve operation angle, ratio RIVO and ratio RIVC become 50%.

On the other hand, as in VEL 112 of the present embodiment, in the case of such a mechanism that the center phase is simultaneously varied by varying the valve operation angle, when the center phase is retarded in response to the increase of valve operation angle as shown in FIG. 9, an angle change amount of closing timing IVC with respect to the change in the valve operation angle becomes larger than an angle change amount of opening timing IVO, and accordingly, ratio RIVO becomes less than 50%.

In other words, in the case where opening timing IVO varies for an angle less than half of the change amount of the valve operation angle and closing timing IVC varies for an angle more than half of the change amount of the valve operation angle, the center phase is retarded in response to the increase in the valve operation angle, and thus, ratio RIVO at that time becomes 0% S RIVO<50%.

Furthermore, ratio RIVO of 0% indicates a characteristic that opening timing IVO is constant (i.e., does not vary) while the valve operation angle is varied, and the valve operation angle varies by varying dosing timing IVC.

For example, when opening timing IVO is advanced for an angle corresponding to 30% of the increased amount of valve operation angle and closing timing IVC is retarded for an angle corresponding to 70% of the same, ratio RIVO is 30% and ratio RIVC is 70%.

In contrast, when the center phase is advanced in response to the increase in the valve operation angle as shown in FIG. 7, an angle change amount of closing timing IVC with respect to the change in the valve operation angle becomes smaller than an angle change amount of opening timing IVO, and accordingly, ratio RIVO becomes more than 50%.

In other words, in the case where opening timing IVO varies for an angle more than half of the change amount of the valve operation angle and closing timing IVC varies for an angle less than half of the change amount of the valve operation angle, the center phase is advanced in response to the increase in the valve operation angle, and thus, ratio RIVO at that time becomes 50% <RIVO≦100%.

Furthermore, ratio RIVO of 100% indicates a characteristic that closing timing IVC is constant (i.e., does not vary) while the valve operation angle is varied, and the valve operation angle varies by varying opening timing IVO.

Because ratios RIVO and RIVC are fixed values which is determined depending on the structure/specification of VEL 112, ratio RIVO and/or ratio RIVC is previously stored.

Moreover, "OPAtar−OPAdef" is an increased amount of the target operation angle with respect to the minimum operation angle, and "(OPAtar−OPAdef)×RIVO" is a change angle of opening timing IVO corresponding to the increased amount. Still further, since "1−RIVO" is equal to RIVC, "(OPAtar−OPAdef)×(1−RIVO)" indicates a change angle of closing timing IVC corresponding to the increased amount of the target operation angle with respect to the minimum operation angle.

Here, IVOdef is opening timing IVO in the default state, and IVCdef is closing timing IVC in the default state. In VEL 112 of the present embodiments, the center phase is retarded in response to the increase in valve operation angle.

Accordingly, "IVOdef−(OPAtar−OPAdef)×RIVO" indicates opening timing IVO that is advanced by varying the valve operation angle from the minimum value to the target value in the state where VTC 113 is fixed to the most retarded angle side. Further, "IVC def+(OPAtar−OPAdef)×(1−RIVO)" indicates closing timing IVC that is retarded by varying the valve operation angle from the minimum value to the target value in the state where VTC 113 is fixed to the most retarded angle side.

After obtaining opening timing IVO and closing timing IVC at the target operation angle, as indicated above, the correction value for correcting the target advance amount is calculated in accordance with the following equation:

$$\text{Correction value}=(\text{IVO}+\text{IVC})/2-\text{SPdef}$$

In this equation, "(IVO+IVC)/2" indicates an angle from the top dead center to the center phase at the target operation angle. Similarly, SPdef indicates an angle from the top dead center to the center phase in the default state of VEL 112 and VTC 113.

Thus, by correcting the target advance amount by the correction value, a center phase can be controlled to the target center phase even if the center phase varies in response to the variation in the valve operation angle.

For example, as shown in FIG. 9, in VEL 112 in which the center phase is retarded as the target operation angle increases, if a default operation angle (reference operation angle) is the minimum operation angle, the positive correction value, the absolute value of which increases as the target operation angle increases, can be set similarly to the characteristics shown in FIG. 15 by the solid line.

In contrast, as shown in FIG. 7, in VEL 112 in which the center phase is advanced as the target operation angle increases, if a default operation angle (reference operation angle) is the minimum operation angle, the negative correction value, the absolute value of which increases as the target operation angle increases, can be set similarly to the characteristics shown in FIG. 15 by the solid line.

After calculating the correction value, as indicated above, in the next step S604 the target advance amount obtained in step S602 is corrected by the correction value, thereby obtaining a final target advance amount.

Then, in the next step S605, VEL 112 is feedback controlled based on the target operation angle that is set in step S602, and VTC 113 is feedback controlled based on the final target advance amount corrected in step S604.

In the followings, calculation of the correction value in step S603 will be described in more specific, with reference to FIG. 17.

Figure 17:
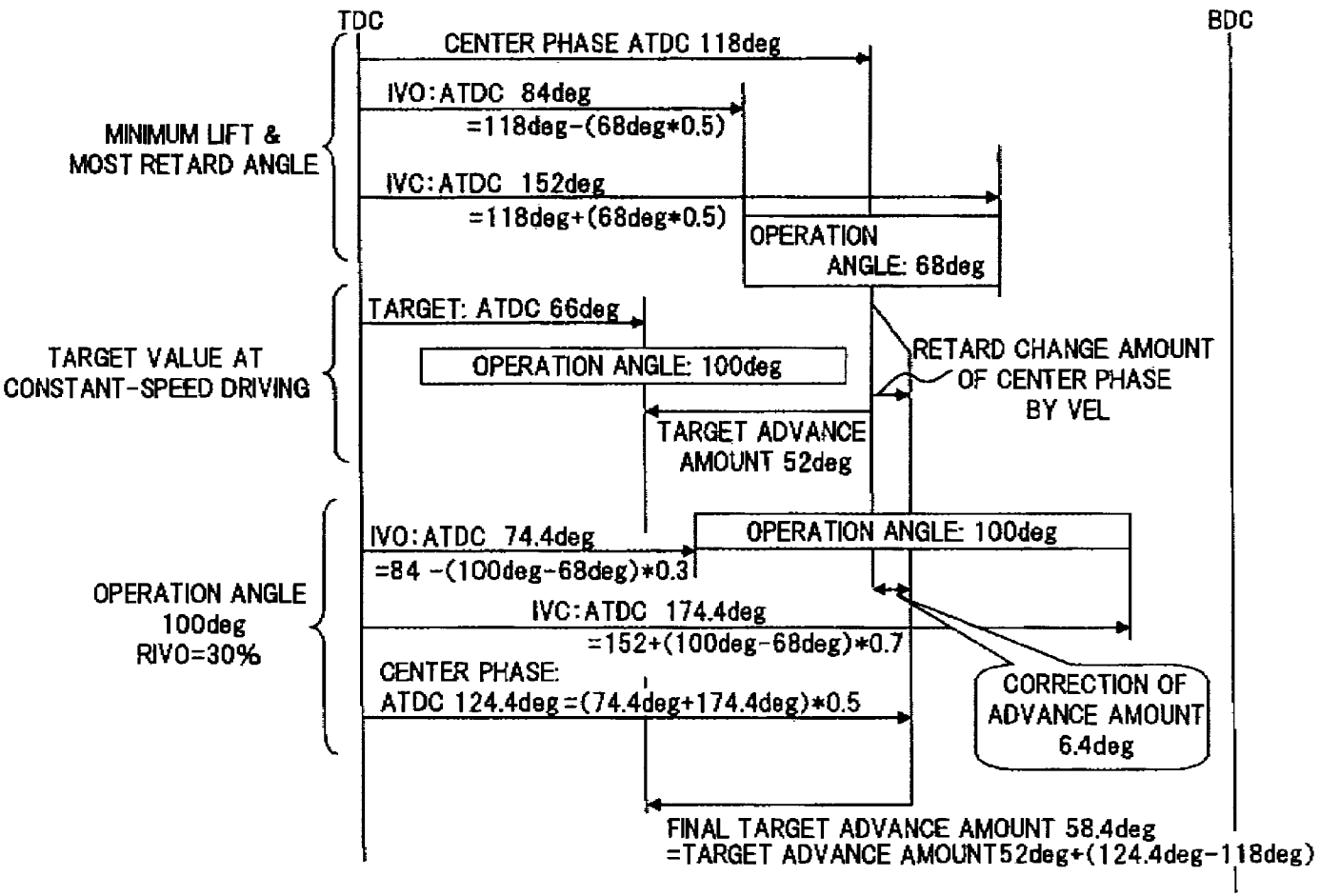
FIG. 17 is a diagrammatic view for explaining a control for shifting open characteristics of an intake valve from a default state to a target at an intermediate-load operation according to the embodiment of the present invention.

FIG. 17 shows the case where the open characteristics of intake valve 105 is changed from that in the default state to the valve characteristics at an intermediate-load operation.

As used herein, the intermediate-load operation means a constant-speed operating state at vehicle speed of approximately 40 km/h and an operating state in which low-fuel consumption is required.

The default state of VEL 112 is a state having the minimum operation angle as described above, and the default state of VTC 113 is a state having the most retarded angle, and accordingly, the center phase at the minimum operation angle/the most retarded angle, and opening timing IVO and closing timing IVC at the minimum operation angle/the most retarded angle position are previously stored.

Here, in the default state, the valve operation angle is set to 68 deg, opening timing IVO is set to 84 degree ATDC (after top-dead-center) (hereinafter, referred to as "deg ATDC"), closing timing IVC is set to 152 deg ATDC, and the center phase is set to 118 deg ATDC.

Then, for the intermediate-load operation time, the target advance amount is set to 52 deg, and the target operation angle is set to 100 deg. Herein, as an example, the case where the center phase of 66 deg ATDC at the valve operation angle of 100 deg is achieved will be described.

If VEL 112 is a mechanism that can vary the valve operation angle without varying the center phase, the center phase does not varies even when only the valve operation angle is varied, and thus, by controlling VTC 113 based on the target advance amount, the target center phase can be obtained.

However, as in the present embodiment, in VEL 112 that varies the center phase to be retarded in response to the increase in the valve operation angle, the center phase might include a difference from the target angle for the change amount of the center phase operated by VEL 112 unless the target advance amount is corrected for the change amount of the center phase operated by VEL 112. Thus, the correction value is calculated from the following equation:

$$IVO=IVOdef-(OPAtar-OPAdef)\times RIVO$$

$$IVC=IVCdef+(OPAtar-OPAdef)\times(1-RIVO)$$

$$\text{Correction value}=(IVO+IVC)/2-SPdef$$

In the example of FIG. 13, opening timing IVO, closing timing IVC, correction value can be calculated as follows. Here, the ratio RIVO is set to be 30%.

$$IVO = 84\text{ deg} - (100\text{ deg} - 68\text{ deg})\times 30\% = 74.4\text{ deg}$$

$$IVC = 152\text{ deg} + (100\text{ deg} - 68\text{ deg})\times(100\% - 30\%) = 174.4\text{ deg}$$

$$\text{Correction value} = (74.4\text{ deg} + 174.4\text{ deg})/2 - 118\text{ deg} = 6.4\text{ deg}$$

The above "(74.4 deg+174.4 deg)/2", from which the correction value can be calculated, indicates the center phase that varies due to the increase in the valve operation angle from the minimum 68 deg to 100 deg while maintaining VTC 113 to be in the most retarded state, and the correction value at that time indicates the retard change amount of the center phase of when the operation angle is varied from 68 deg (i.e., the minimum value) to 100 deg by VEL 112.

On the other hand, the target advance amount of 52 deg is such a target value that it is set by assuming that the center phase does not vary even the valve operation angle varies. Thus, if the center phase is retarded for 6.4 deg by setting the target operation angle to 100 deg, the starting point of advancing operation is position to be more retarded, and accordingly, it becomes necessary to set the target advance amount to a value on the advanced side for extra 6.4 deg in addition to 52 deg.

Consequently, by setting the target advance amount as the sum of 52 deg and 6.4 deg, 66 deg ATDC, which is the target center phase, can be achieved.

Figure 18:
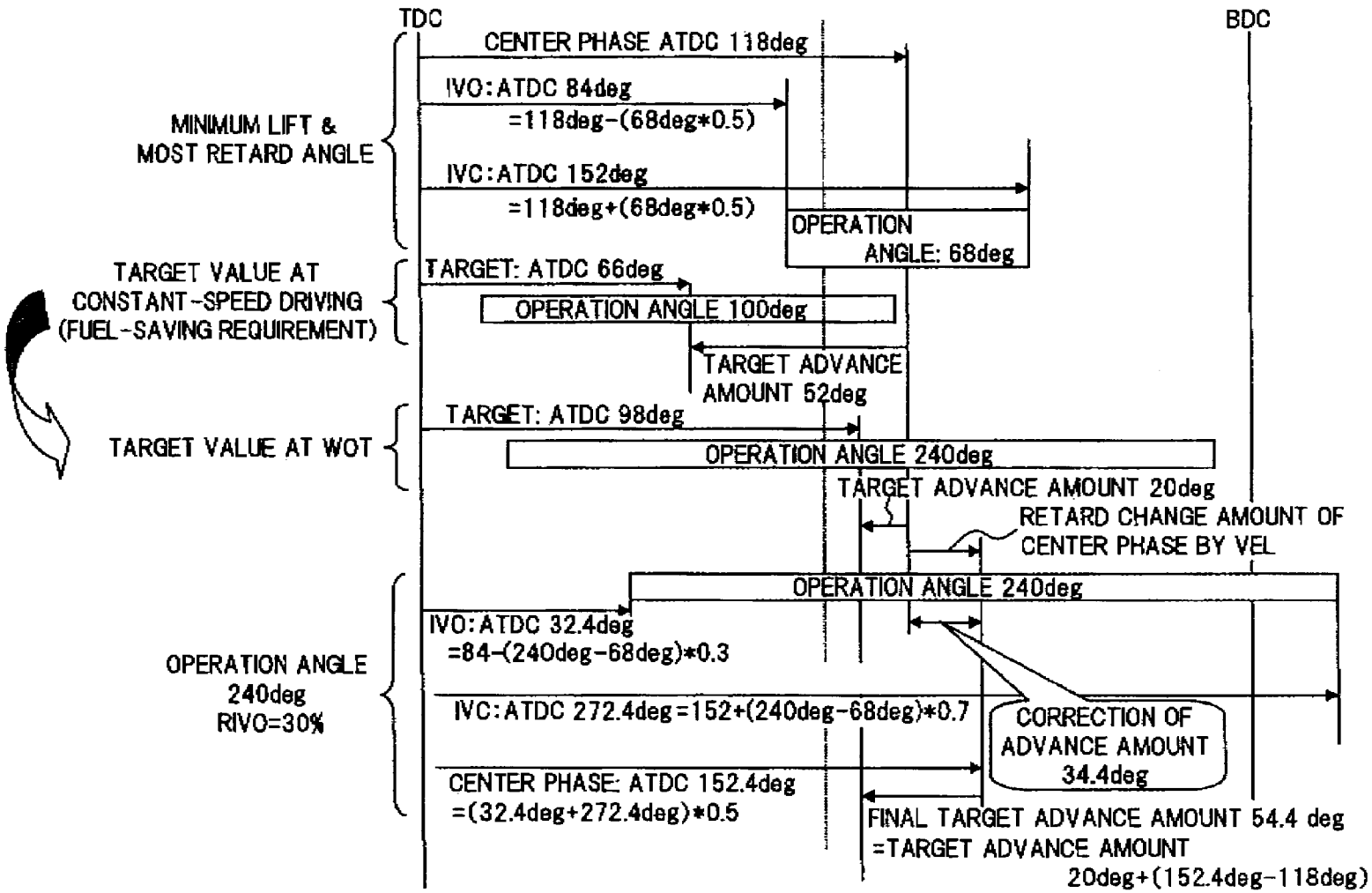
FIG. 18 is a diagrammatic view for explaining a control for shifting the open characteristics of the intake valve from the target at the intermediate-load operation to a target at a full throttle operation according to the embodiment of the present invention.

FIG. 18 shows the change of open characteristics of intake valve 105 of when the operating state is changed from the intermediate-load operation in which the target operation angle is set to 100 deg and the target center phase is set to 66 deg ATDC to the operating state where the accelerator pedal is fully operated.

Here, since the accelerator pedal is fully operated, the target center phase is changed from 66 deg ATDC to 98 deg ATDC. In accordance with this change, the target advance amount of VTC 113 is changed from 52 deg to 20 deg, and the target operation angle at the state where the accelerator pedal is fully operated (WOT) is set to 240 deg.

Under these conditions, opening timing IVO, dosing timing IVC, correction value can be calculated as follows.

$$IVO = 84\text{ deg} - (240\text{ deg} - 68\text{ deg})\times 30\% = 32.4\text{ deg}$$

$$IVC = 152\text{ deg} + (240\text{ deg} - 68\text{ deg})\times(100\% - 30\%) = 272.4\text{ deg}$$

$$\text{Correction value} = (32.4\text{ deg} + 272.4\text{ deg})/2 - 118\text{ deg} = 34.4\text{ deg}$$

Thus, in the case where the operating state is changed from the state where the target operation angle is 100 deg and the target center phase is 66 deg ATDC to the state where the accelerator pedal is fully operated, the target center phase can be achieved by correcting the target advance amount of 20 deg to 54.4 deg.

Thus, even if the target advance amount, which is set relative to the target torque and the engine rotating speed, is set as an advance amount from the center phase at the default state, the center phase can be controlled to achieve the target center phase with high precision by using the correction value.

Figure 16:
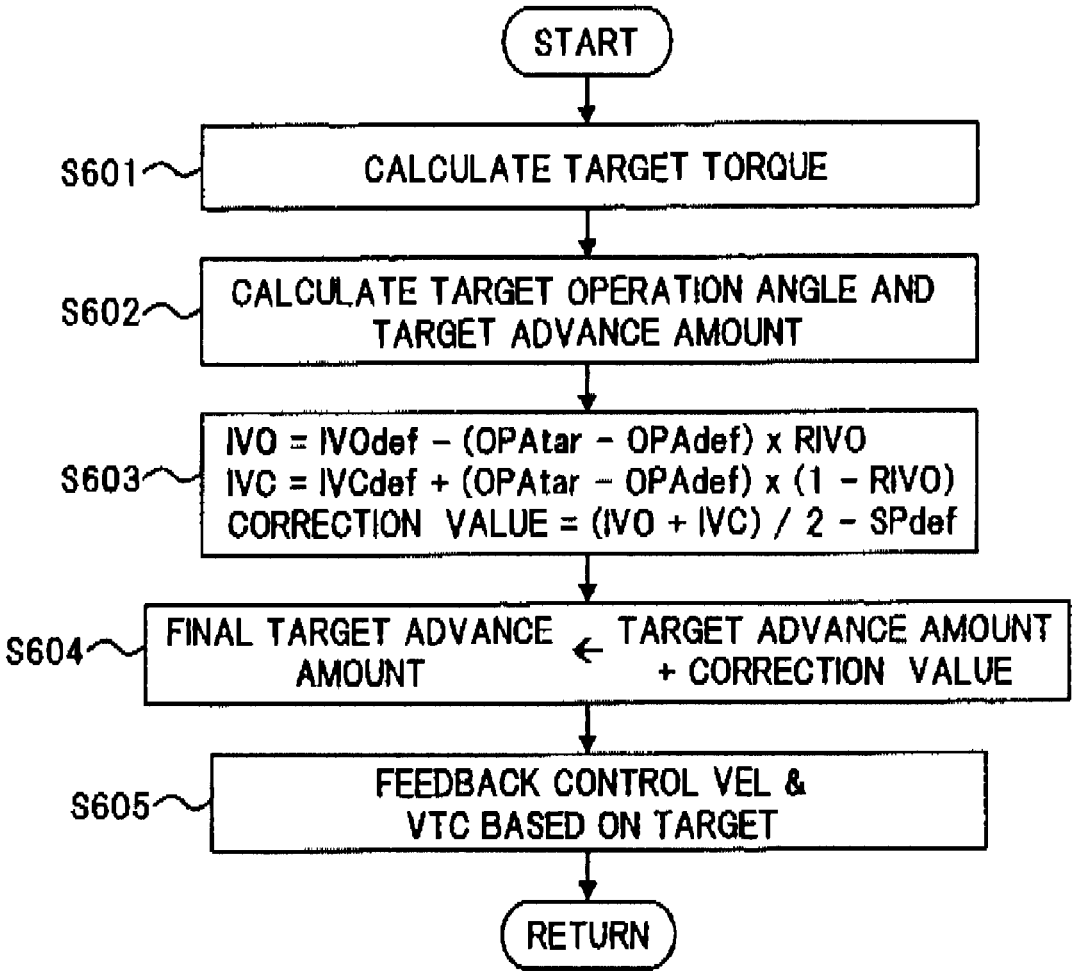
FIG. 16 is a flowchart illustrating the correction control of the target value of the variable valve timing mechanism according to the embodiment of the present invention.
Figure 19:
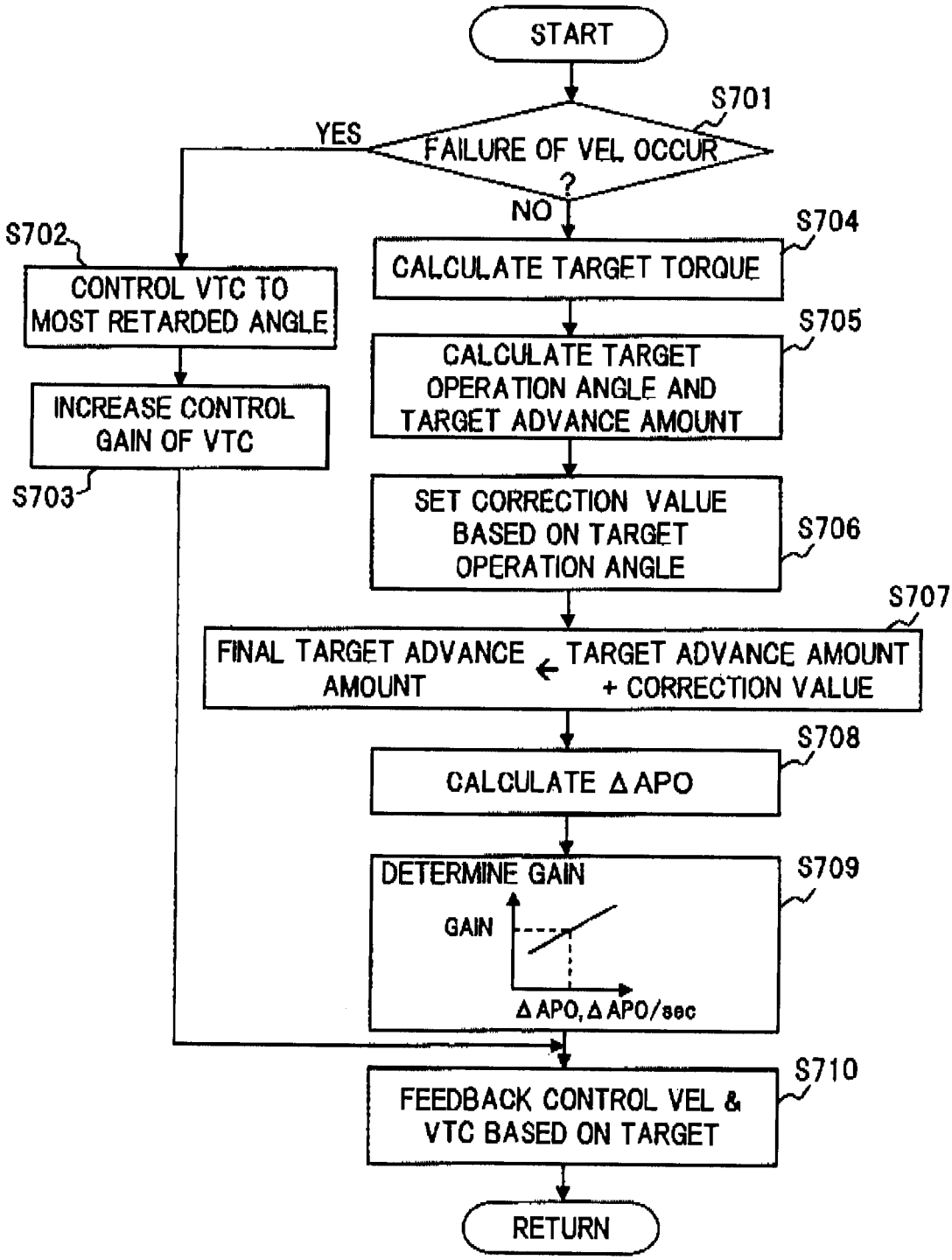
FIG. 19 is a flowchart illustrating the correction control of the target value, and a failsafe control, of the variable valve timing mechanism according to the embodiment of the present invention.

FIG. 19 shows a flowchart indicating a third embodiment of the present invention, in which a failsafe control is executed in the case where an abnormality has occurred in VEL 112, while performing correction of the target advance amount as shown in the flowchart of FIG. 11 or 16.

In step S701 of the flowchart of FIG. 19, it is diagnosed whether or not a failure of VEL 112 has occurred.

The failure diagnosis of VEL 112 is executed by a separate program (not shown in the figure). When it is determined that the failure has occurred, a failure determination flag is set at 1, and when it is determined that VEL 112 is normal, the failure determination flag is set at 0. Consequently, in the step S701, discrimination of failure/normal is performed by discriminating the failure determination flag.

As a failure of VEL 112, there is included an abnormality in operation caused by a breaking or a short circuit of a power supply line and/or driving signal line, a fixation of the driving portions due to a foreign matter caught therebetween, and the like.

In particular, if the rotating phase is advanced by VTC 113 in the case where the valve operation angle and valve lift amount are large and VEL 112 is unable to work, a valve lift amount near the top dead center of a piston might be abnormally large, and thus intake valve 105 and the piston might interfere with each other.

Thus, if it is discriminated in step S701 that the failure of VEL 112 has occurred, the flow proceeds to step S702 in order to avoid the occurrence of the interference of piston, or the like.

The abnormality discriminated in step S701 may be limited to an abnormality that the valve operation angle and the valve lift amount are fixed to the larger value, or an abnormality that the valve lift amount is controlled to a larger value than a target value, to thereby set a main object of the failsafe control to an avoidance of piston interference.

In step S702, a target advance amount of VTC 113 is forcibly set to the a most retarded angle, and in the next step S703, a gain in a feedback control of VTC 113 is switched to a gain larger than that in the case where VEL 112 is normal, to thereby converge the actual advance amount to the target advance amount which is set to the most retarded angle, with good response.

In the case where the feedback control is executed by the proportional plus integral action based on a control error, for example, the above-mentioned gain is a proportional gain plus integral gain, and further, if it is discriminated that the failure of VEL 112 has occurred, the proportional gain plus integral gain is changed to the larger value than that in the case where VEL 112 is normal.

Thus, even if the abnormality of the valve operation angle and the valve lift amount to be fixed to the larger value occurs in VEL 112, the valve lift amount near the top dead center can be set smaller by promptly retarding the center phase of intake valve 105, and thus, the interference between intake valve 105 and the piston can be avoided.

In contrast, if it is determined in step S701 that VEL 112 is normal, the flow proceeds to steps S704 through S707, and then a target operation angle and a target advance amount are determined as with the above steps S501 through S504.

The setting process of a correction value in step S706 may be such a process that the correction value is set by being retrieved from a table based on the target operation angle as indicated in the above step S503, and further the process may be such a process that the correction value is obtained by performing computation processes based on the opening/closing timing of intake valve 105 at the target operation angle.

In step S708, a value indicating a load variation of engine 101, such as a temporal derivative value ΔAPO of an accelerator opening degree APO, is calculated, and then a determination of a transient operation state of engine 101 is performed.

In step S709, based on the value indicating the variation of engine load, such as the temporal derivative value ΔAPO of the accelerator opening degree APO, a feedback gain of VTC 113 is set.

At this time, if the absolute value of the temporal derivative value ΔAPO is large and the engine is in an abrupt acceleration/deceleration state, the feedback gain is set larger.

Consequently, at the transient operation of engine 101, closing timing IVC of intake valve 105 can be converged to the target with good response, and a response to an intake air amount control can be improved, and accordingly, a response of engine can be improved.

In step S710, VEL 112 and VTC 113 are feedback controlled based on a target value and a control gain.

As described above in each embodiment, it will be apparent to those skilled in the art that the present invention can be adopted to either type of VEL 112, namely, such types that the center phase is either advanced or retarded in response to the increase in the valve operation angle, and further, can be adopted to the case where a valve operation angle of an exhaust valve is varied.

Figure 20:
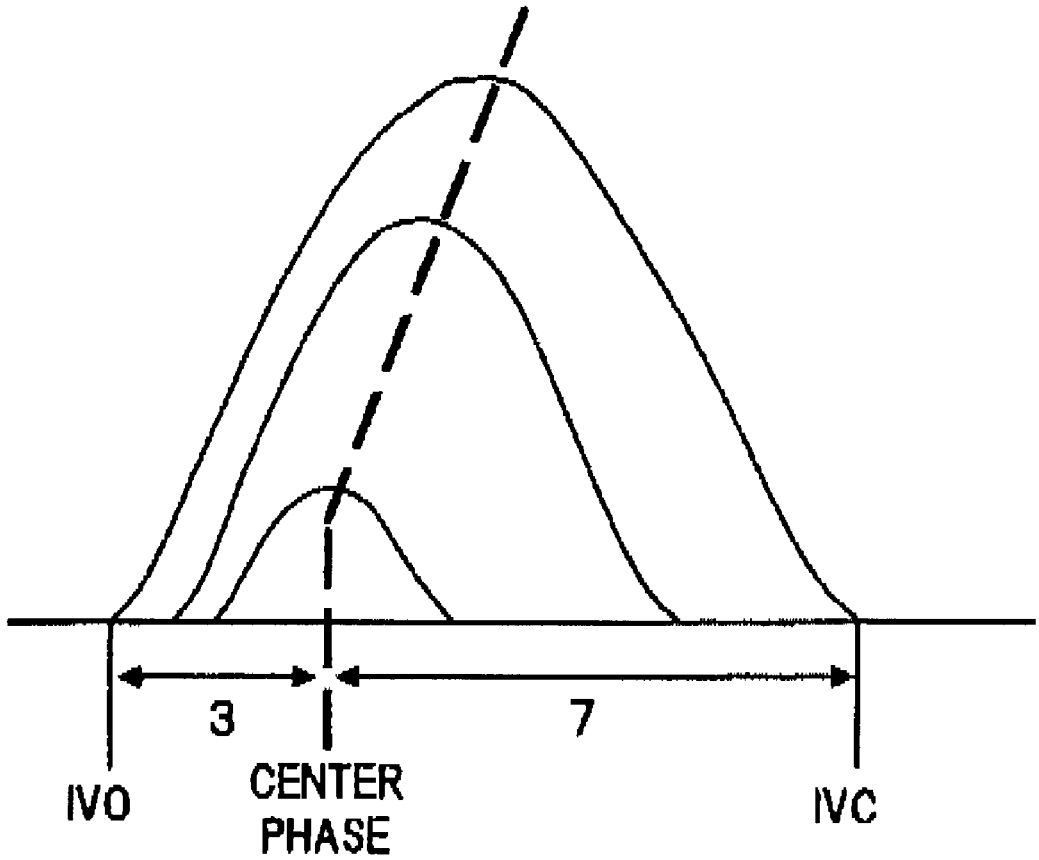
FIG. 20 is a graphical view illustrating variation characteristics of the valve operation angle and the valve lift amount of the intake valve according to the embodiment of the present invention.

In VEL 112 which is provided for varying the valve operation angle of intake valve 105, however, it is preferable to employ the characteristics that the center phase is retarded in response to the increase in the valve operation angle of intake valve 105, as shown in FIG. 9, and furthermore, it is preferable to set the above-mentioned ratio RIVO to be 30%, as shown in FIG. 20.

By setting ratio RIVO to be 30%, a response at a transient operation, fuel-saving benefit at the transient operation, and an engine-stall resistance at engine cooling time and at engine deceleration time, can be simultaneously achieved.

In the followings, effects obtained by setting ratio RIVO to be 30% will be described in detail.

Regarding Improvement of Response at Transient Operation

Figure 21:
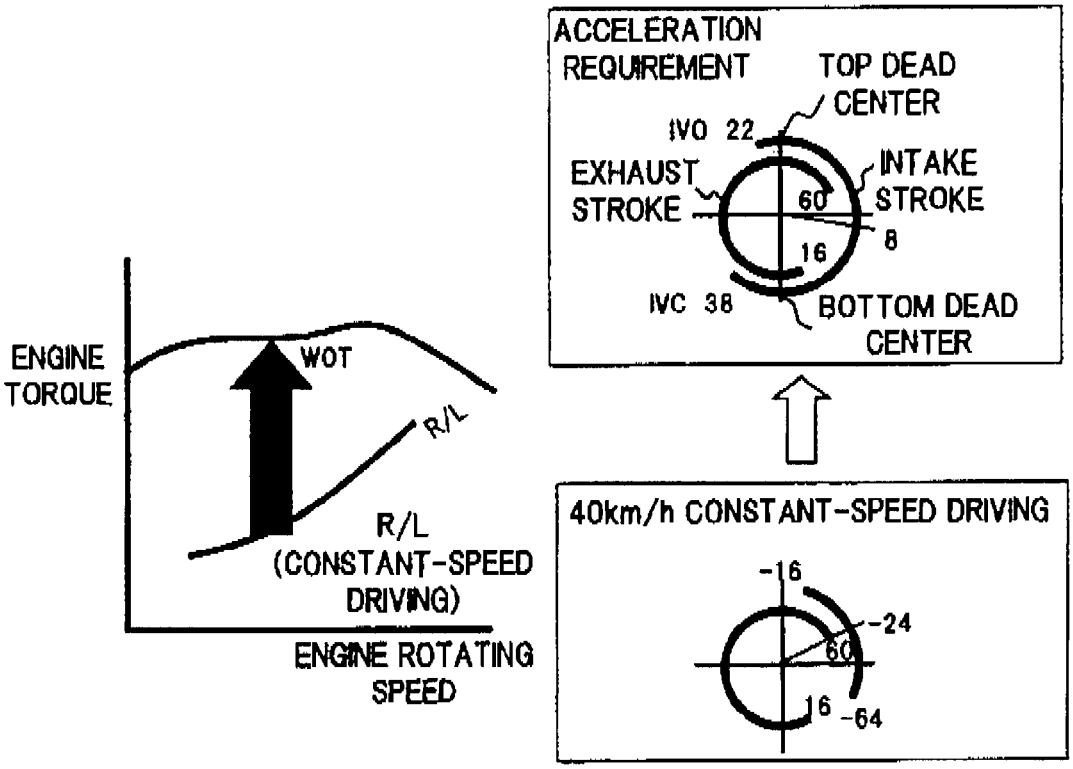
FIG. 21 is a diagrammatic view for indicating a variation in an opening timing of the intake valve in the case where the intermediate-load operation is shifted to the full throttle operation according to the embodiment of the present invention.

As shown in FIG. 21, in order to achieve fuel-saving at a constant-speed operation at a vehicle speed of 40 km/h, for example, it is desired to retard opening timing IVO of intake valve 105 to an angle after the top dead center, to thereby reduce valve overlap, so that a fresh air amount and a fuel injection amount are reduced, and it is also desired to advance closing timing IVC of intake valve 105 to an angle before the intake bottom dead center, to thereby reduce a pumping loss.

On the other hand, when an acceleration requirement occurs, it is preferable to increase the valve lift amount/valve operation angle of intake valve 105 to increase the intake air amount, and to retard closing timing IVC of intake valve 105 to an angle after the intake bottom dead center to improve a filling efficiency inside the cylinder by the inertia supercharging effect.

Thus, when the engine is accelerated from the steady state, a faster control response of valve overlap amount is required, and more particularly, it is important to improve responsiveness of the retard change of closing timing IVC of intake valve 105.

Here, as shown in FIG. 20, by employing VEL 112 having characteristics that the center phase is retarded in response to the increase in the valve operation angle/valve lift amount of intake valve 105, the valve operation angle of intake valve 105 is increased in response to the acceleration requirement, resulting that the center phase can be simultaneously retarded, and further, the phase can be operated in the retard direction by VTC 113.

Thus, since the retard change of the phase operated by VEL 112 and the retard change of the phase operated by VTC 113 simultaneously occur, response of retard change of closing timing IVC at the time of acceleration becomes faster, and thus, closing timing IVC can be retarded to an angle after the intake bottom dead center and the inertia supercharging effect can be obtained immediately, so that the acceleration response can be improved.

Figure 22:
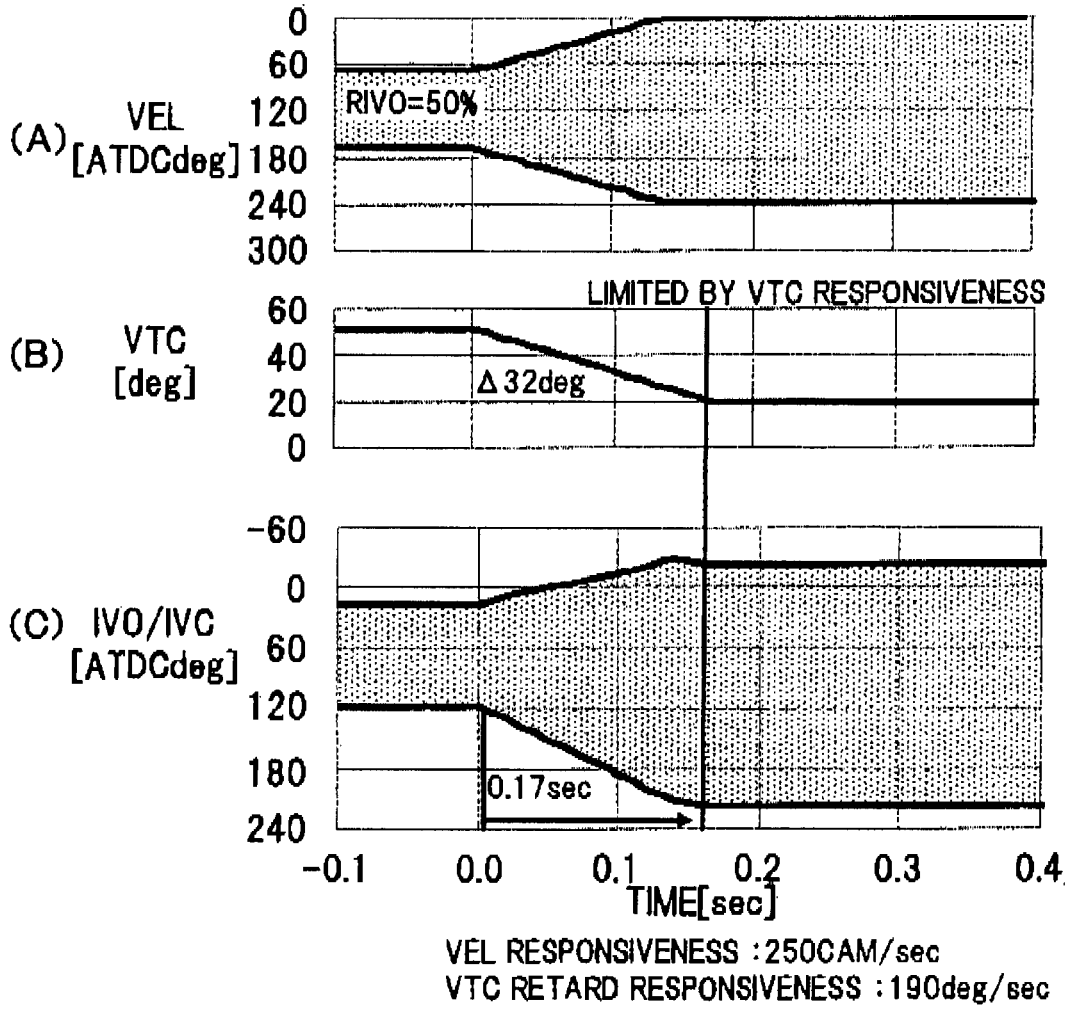
FIG. 22 is a time chart illustrating a variation in opening timing IVO of the intake valve caused by the shift from the intermediate-load operation to the full throttle operation, when a ratio RIVO, which is a ratio of a change amount of opening timing IVO to a change amount of the valve operation angle, is set to 50%, according to the embodiment of the present invention.

FIG. 22 shows the change in valve operation angle performed by VEL 112, the change in advance amount of phase operated by VTC 113, and the change in opening timing IVO/closing timing IVC of intake valve 105, in the case where the engine employing VEL 112 in which ratio RIVO is set to be 50% and the center phase does not vary while the valve operation angle is increased is used and where the operating state is changed from the constant-speed operation at immediate-lode to the operating state where the accelerator pedal is fully operated.

Figure 23:
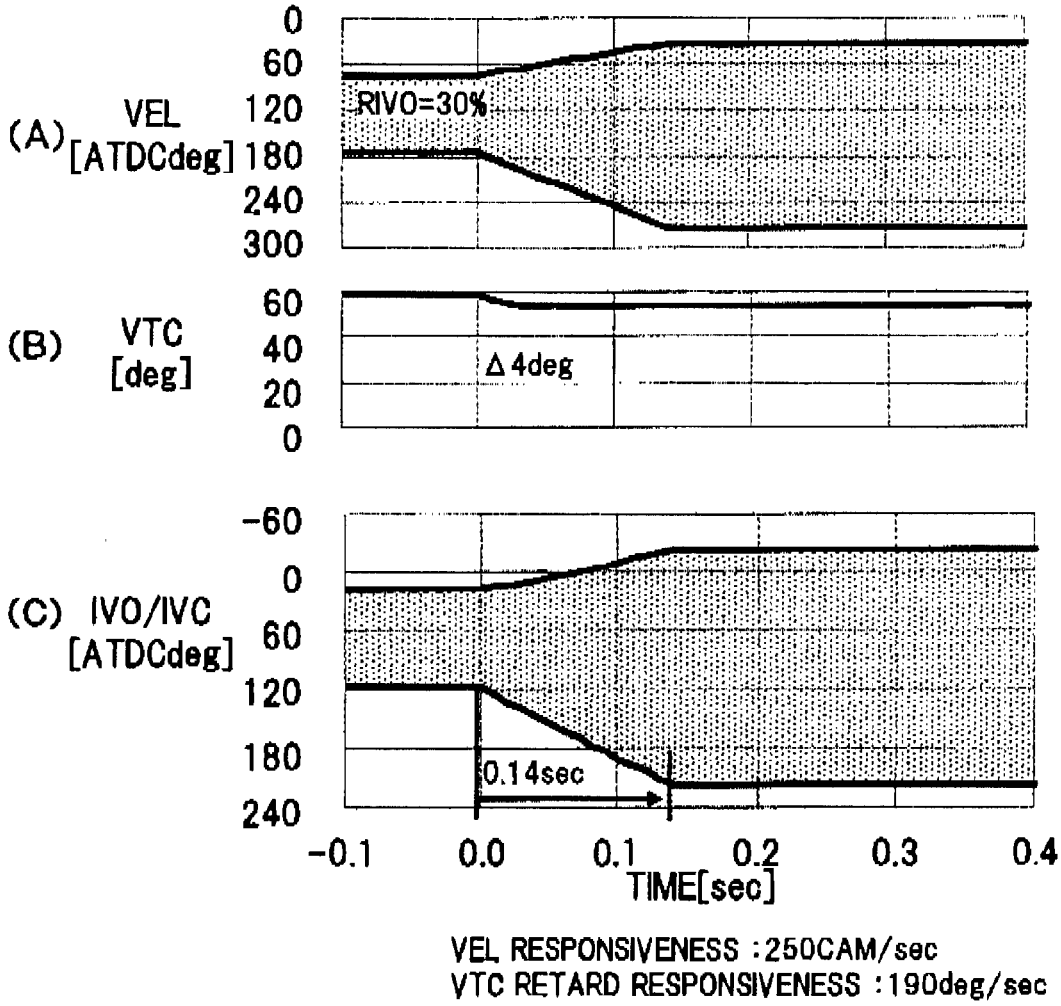
FIG. 23 is a time chart illustrating the variation in the opening timing of the intake valve caused by the shift from the intermediate-load operation to the full throttle operation, when ratio RIVO is set to be 30%, according to the embodiment of the present invention.

Furthermore, FIG. 23 shows the change in valve operation angle operated by VEL 112, the change in advance amount of phase operated by VTC 113, and the change in opening timing IVO/closing timing IVC of intake valve 105, in the case where the engine employing VEL 112 in which ratio RIVO is set to be 30% and the center phase varies to be retarded in response to the increase in the valve operation angle is used and where the operating state is changed from the constant-speed operation at immediate-lode to the operating state where the accelerator pedal is fully operated.

In the case where ratio RIVO is set to be 50% as shown in FIG. 22(A), opening timing IVO and closing timing IVC vary at equal rate. Then, in order to vary the center phase to the target, VTC 113 retards the phase for 32 deg as shown in FIG. 22(B).

Accordingly, even when the valve operation angle reaches the target, closing timing IVC does not reach the target value until VTC 113 completes to retard the phase for 32 deg. In this example, it takes 0.17 sec to reach the target closing timing IVC (see FIG. 22(C)).

In contrast, in the case where ratio RIVO is set to be 30%, the center phase is retarded in response to the increase in the valve operation angle, as shown in FIG. 23(A), and thus, the manipulated variable that is needed to be retarded by VTC 113 can be reduced. In the example shown in FIG. 23(B), VTC 113 retards the phase for only 4 deg, thereby achieving closing timing IVC to reach the target value.

Thus, as shown in FIG. 23(C), since no delay in reaching the target value as caused by the delay in response of VTC 113 occur, it takes only 0.14 sec to reach the target closing timing IVC, which is faster than that in the case where ratio RIVO is set to be 50%.

Hence, by employing VEL 112 that retards the center phase in response to the increase in the valve operation angle of intake valve 105, time before reaching the target closing timing IVC can be reduced and the inertia supercharging effect cam be obtained sooner, so that the response of acceleration can be improved.

Figure 24:
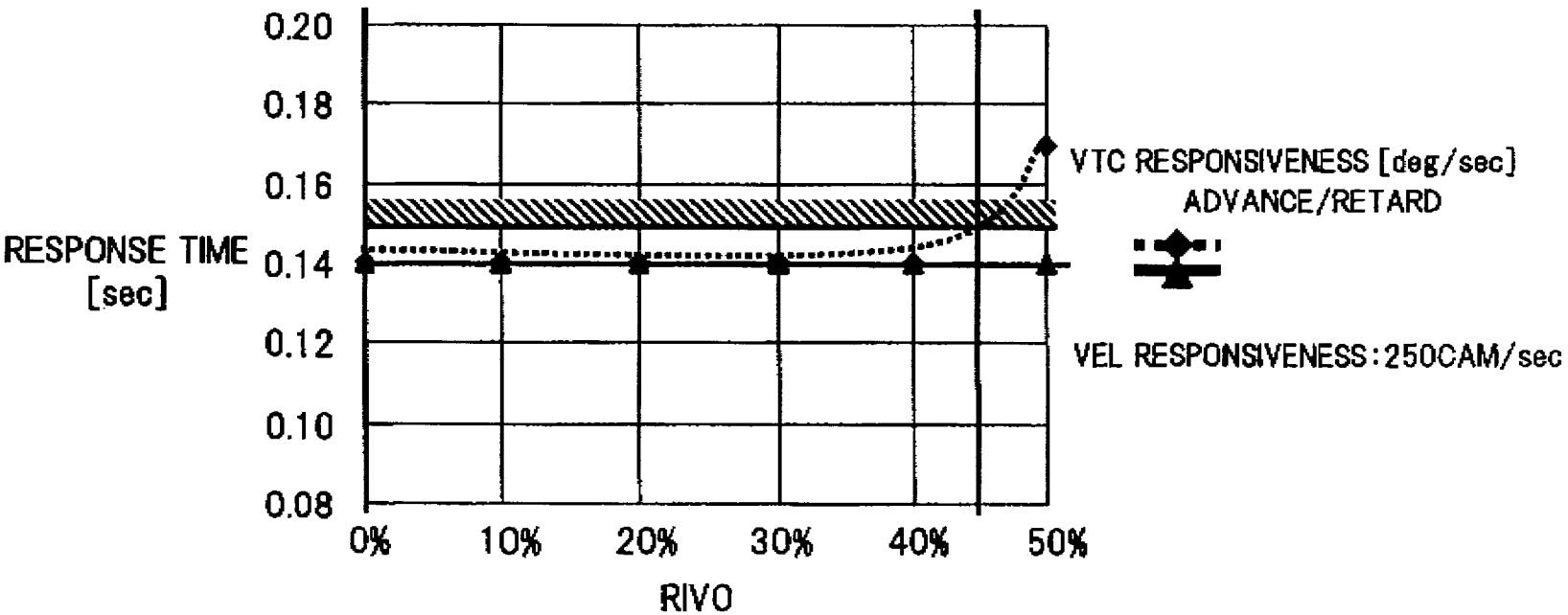
FIG. 24 is a graphical view illustrating a correlation between ratio RIVO and a response time of an intake air amount according to the embodiment of the present invention.

FIG. 24 shows a diagrammatic view indicating the relationship between ratio RIVO/RIVC and a response time of intake air amount.

In FIG. 24, the characteristics that ratio RIVO is set to be 0% and ratio RIVC is set to be 100% are such characteristics that opening timing IVO of intake valve 105 is constant and only dosing timing IVC varies in order to vary the valve operation angle of intake valve 105 by VEL 112. The characteristics that both ratios RIVO and RIVC are set to be 50% are such characteristics that the center phase does not vary even when the valve operation angle is varied by VEL 112.

Each of the dotted line and the solid line in FIG. 24 indicates the response time of VTC 113 with different response speeds. The dotted line indicates the characteristics that have relatively slow response speed and the characteristics of the vane-type variable valve timing mechanism employed in the present embodiment.

As ratio RIVO approaches 50%, the retard manipulated variable required by VTC 113 becomes large. Thus, as shown in FIG. 24 by the dotted line, if VTC 113 has slower response speed and if ratio RIVO exceeds 40%, time required for retarding the phase for the desired angle by VYC 113 becomes longer than the time required for varying the valve operation angle. Accordingly, the delay in reaching target closing timing IVC might occur, and thus, the longer response time might be required.

Thus, in the combination of VEL 112 and VTC 113 of the present embodiment, it is preferable to set ratio RIVO within the range from 0% to 40%, in order to shorten the response time required for varying the intake air amount and improve the response.

Regarding Fuel-Saving at Transient Operation

In investigating the fuel consumption at the transient operation, suppose that the vehicle is in an operation pattern shifting from the acceleration state by stepping on the accelerator pedal to the constant-speed operation by decelerating by releasing the accelerator pedal, namely, in the operation pattern opposite to that indicated in FIG. 21.

In this operation pattern, closing timing IVC of intake valve 105 is quickly advanced from an angle after the bottom dead center to an angle before the bottom dead center, so that the pumping loss can be reduced and thus the fuel consumption can be reduced. Moreover, by employing VEL 112 configured to retard the center phase in response to the increase in the valve operation angle, closing timing IVC can be quickly advanced, and accordingly, the reduction of the fuel consumption can be achieved.

Figure 25:
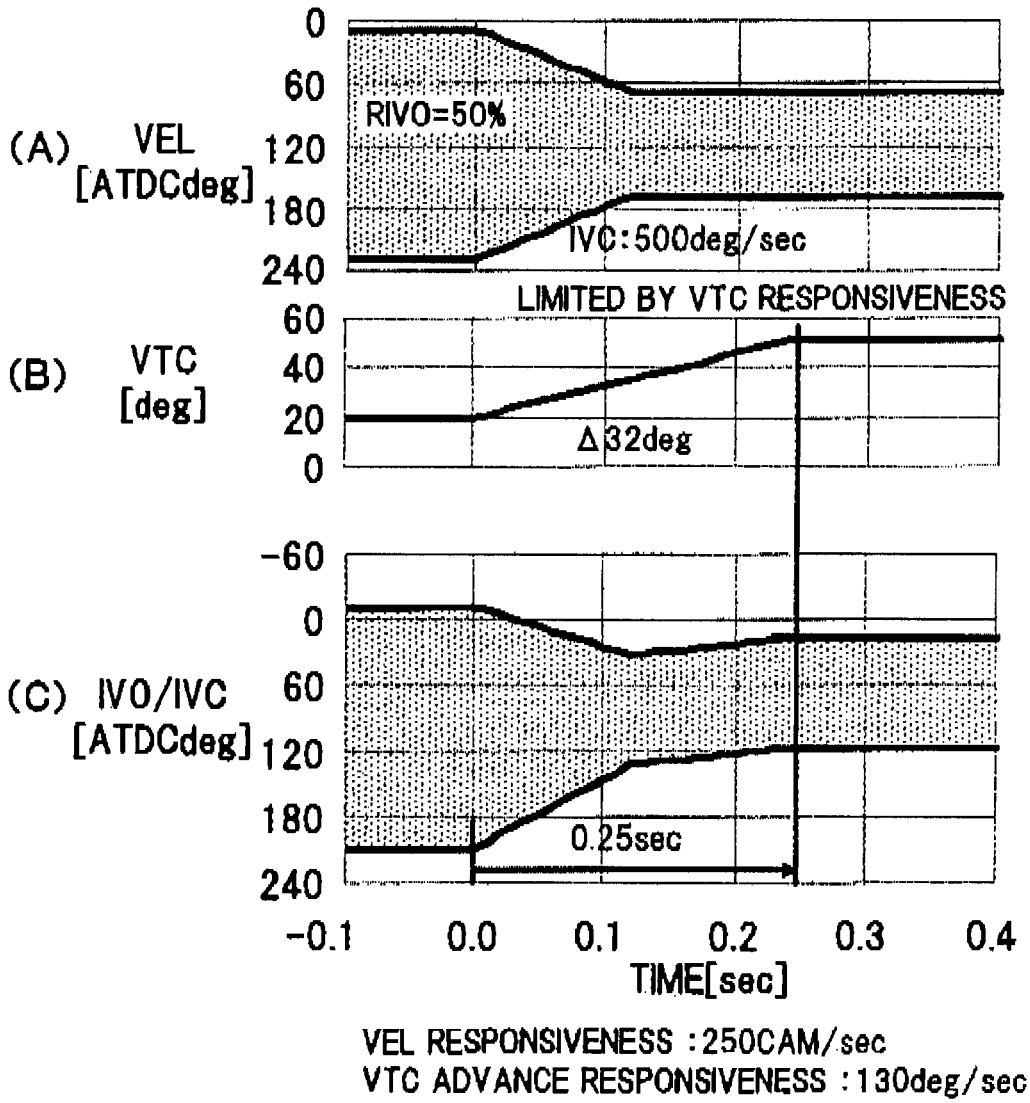
FIG. 25 is a time chart illustrating the variation in the opening timing of the intake valve caused by the shift from an acceleration operation to a constant-speed operation, when ratio RIVO is set to be 50%, according to the embodiment of the present invention.
Figure 26:
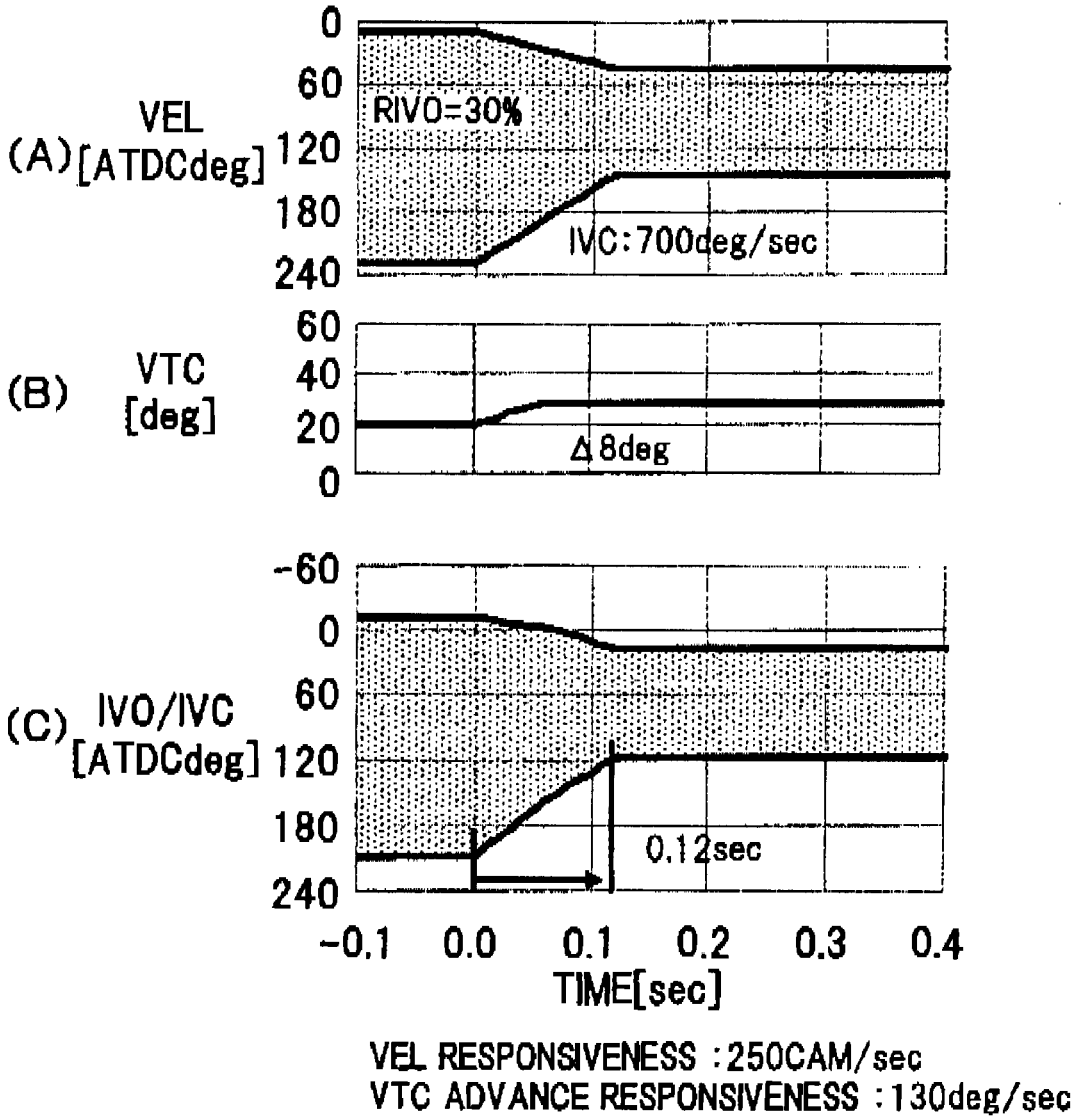
FIG. 26 a time chart illustrating a variation in the opening timing of the intake valve caused by the shift from the acceleration operation to the constant-speed operation, when ratio RIVO is set to be 30%.

FIGS. 25 and 26 show the change in valve operation angle operated by VEL 112, the change in advance amount of phase operated by VTC 113, and the change in opening timing IVO/closing timing IVC of intake valve 105, during deceleration. FIG. 25 shows the case where ratio RIVO is 50%, and FIG. 26 shows the case where ratio RIVO is 30%.

In the case where there is employed VEL 112 in which the center phase does not vary while the valve operation angle is varied, namely, ratio RIVO is set to be 50%, it is necessary to advance the phase for 32 deg by VTC 113, as shown in FIG. 25(B). The time required for advancing the phase for 32 deg limits the time required for dosing timing IVC to reach the target timing, and thus closing timing IVC takes 0.25 sec to be advanced to the target timing.

In contrast, in the case where there is employed VEL 112 in which ratio RIVO is set to be 30%, since the center phase is advanced in response to the decrease in the valve operation angle, VTC 113 is required to advance the phase for only 8 deg (see FIG. 26(B)), and accordingly, closing timing IVC can be advanced to the target timing in 0.12 sec.

Thus, by employing VEL 112 that advances the center phase in response to the decrease of the valve operation angle, the time required for advancing closing timing IVC to the target timing can be reduced, and thus, the fuel consumption during deceleration can be reduced.

Figure 27:
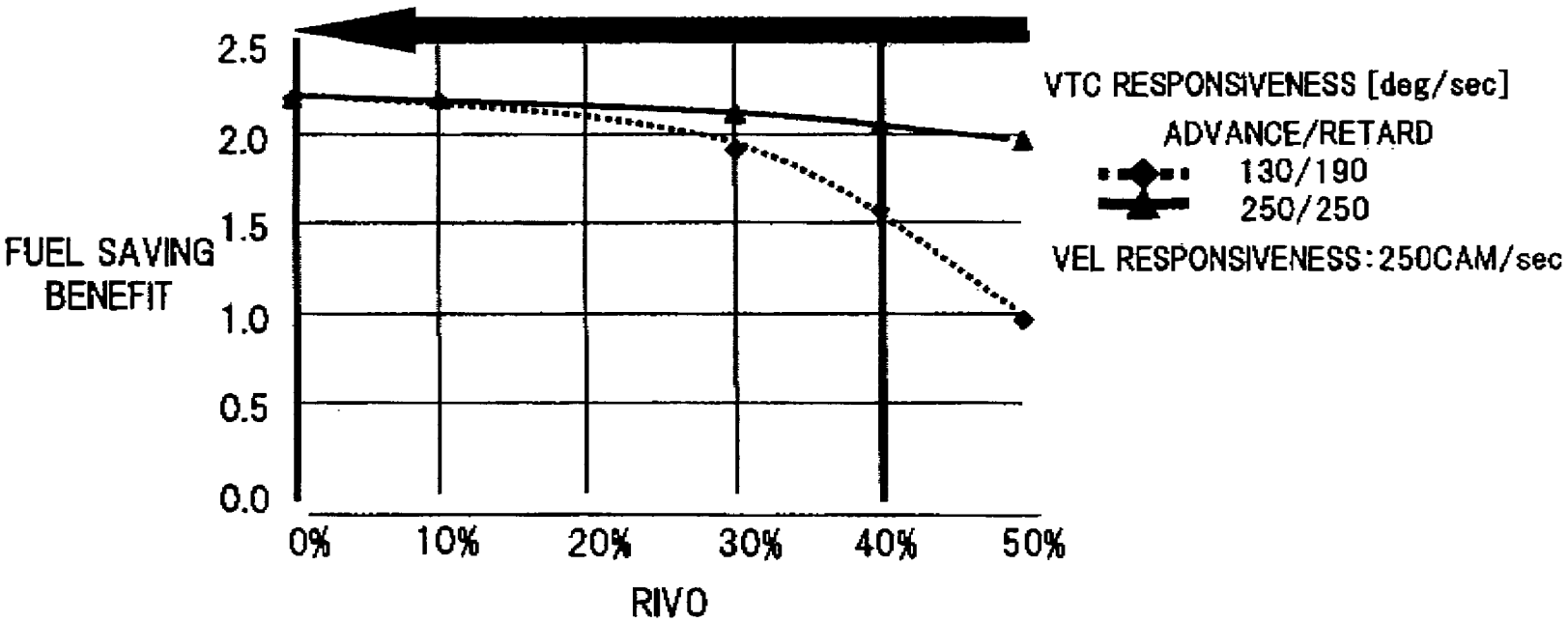
FIG. 27 is a graphical view illustrating a correlation between ratio RIVO and a fuel saving benefit according to the embodiment of the present invention.

FIG. 27 shows a correlation between ratio RIVO and the fuel saving benefit, and shows rapid decrease in the fuel saving benefit from the time point where ratio RIVO exceeds 30%. Thus, it is preferable to set ratio RIVO within the range from 0% to 30%.

In other words, when ratio RIVO exceeds 30%, the time required for performing advance operation by VTC 113 exceeds the time required for decreasing the valve operation angle, and thus, for this excess in time, the delay in advancing the closing timing IVC to the target timing occurs.

On the other hand, when ratio RIVO is 30% or less, the time required for performing advance operation by VTC 113 is less than the time required for decreasing the valve operation angle, and thus, closing timing IVC can be advanced to the target timing with good response, so that the pumping loss can be decreased quickly, and accordingly, the fuel consumption can be reduced.

In the vertical axis of FIG. 27 representing the fuel saving benefit, as the value gets greater, the fuel consumption becomes less.

Regarding Engine Stall Resistance

Figure 28:
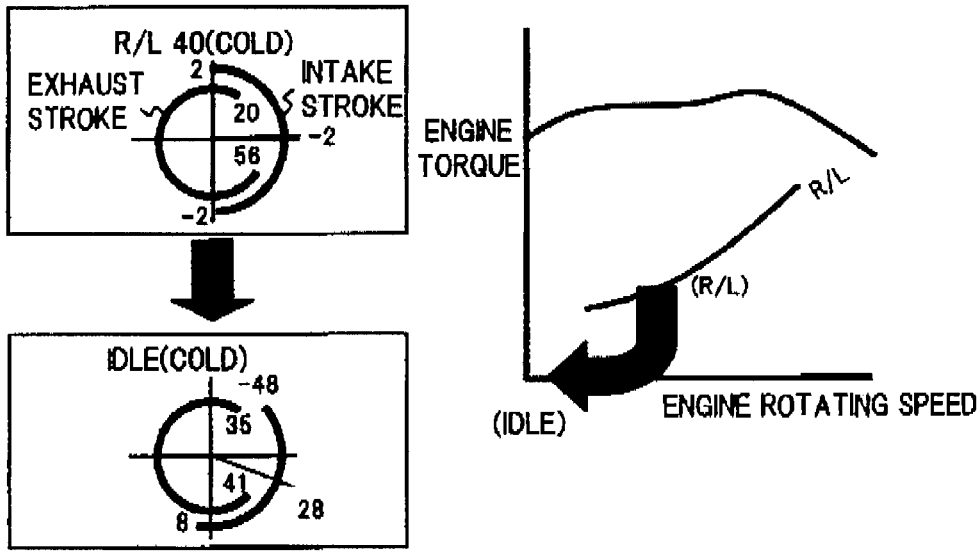
FIG. 28 is a diagrammatic view for indicating the variation in the opening timing of the intake valve in the case where the intermediate-load operation is shifted to an idle operation according to the embodiment of the present invention.

FIG. 28 shows the difference in opening timing of intake valve 105 between the constant-speed operating state at the vehicle speed of 40 km/h and an idle operating state, at engine cooling time.

During idle operation, in order to ensure the combustion stability, it is preferable to set opening timing IVO and closing timing IVC of intake valve 105 in a manner that; the valve overlap amount is decreased to reduce the residual gas amount in a cylinder and introduce more fresh air therein; and closing timing IVC of intake valve 105 is set at the vicinity of the top dead center, to thereby improve an effective compression ratio.

Thus, in the operation pattern shifting from the constant-speed operation to the idle operation by releasing the accelerator pedal to be fully closed, it is necessary to quickly retard opening timing IVO of intake valve 105, to thereby quickly reduce the valve overlap amount, in order to maintain the engine stall resistance.

However, in the case where VEL 112 that retards the center phase in response to the increase in the valve operation angle, the center phase is advanced in response to the decrease in the valve operation angle. Thus, although opening timing IVO is required to be retard quickly, VEL 112 is operated in the direction of advancing the opening timing IVO, and thus, this movement of VEL 112 hinders opening timing IVO from being retarded.

Figure 29:
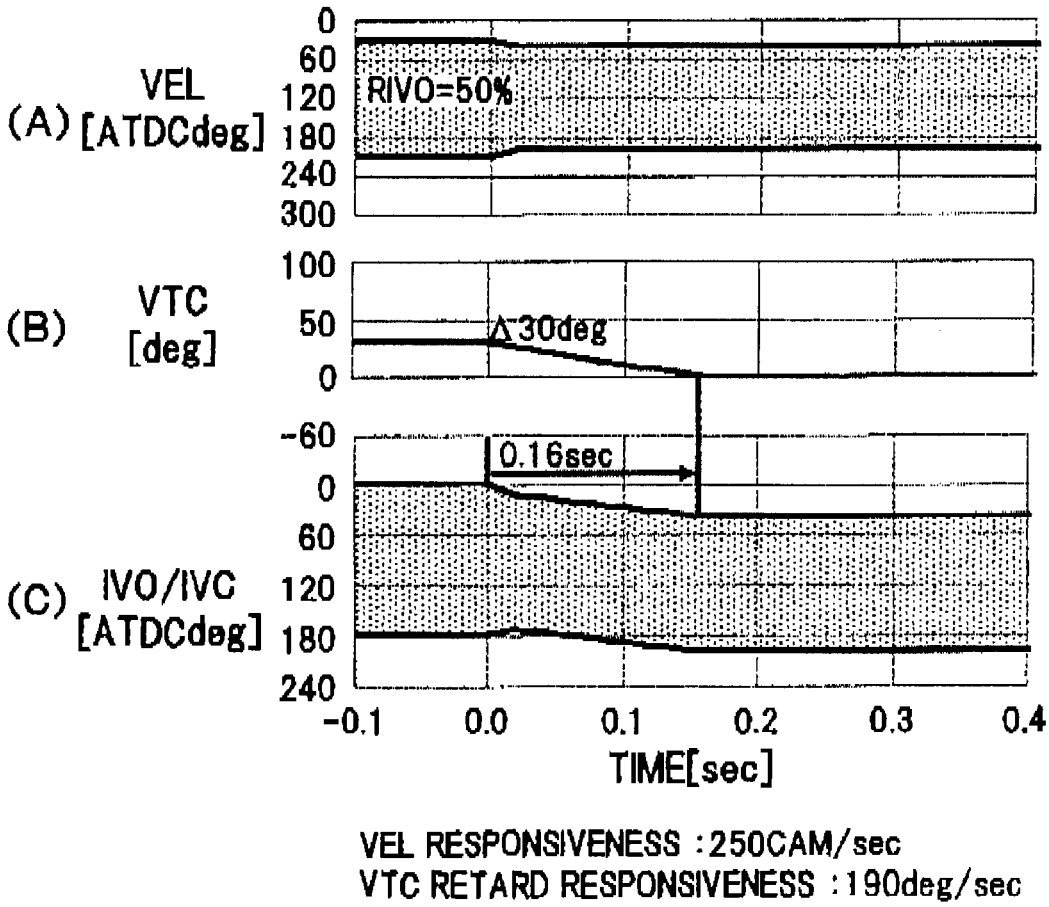
FIG. 29 is a time chart illustrating the variation in the opening timing of the intake valve caused by the shift from the intermediate-load operation to the idle operation, when ratio RIVO is set to be 50%, according to the embodiment of the present invention.
Figure 30:
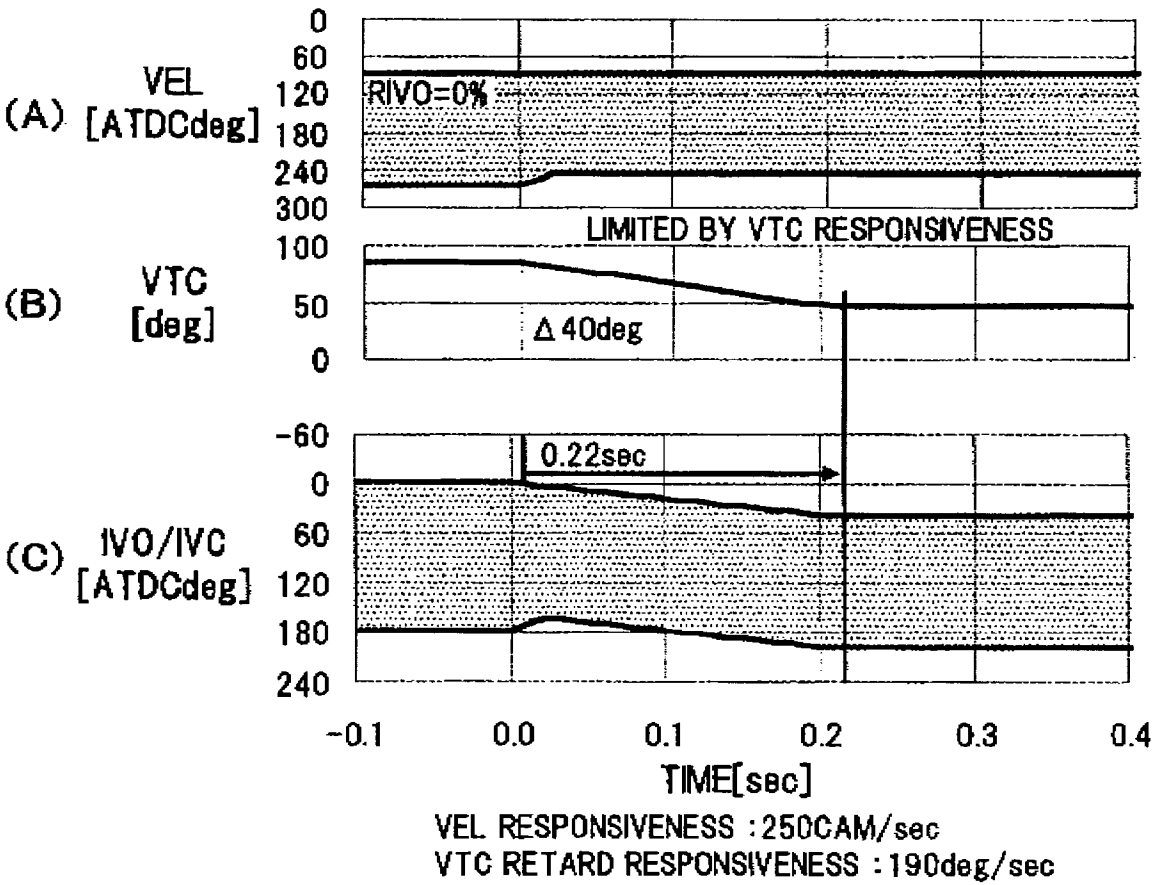
FIG. 30 is a time chart illustrating the variation in the opening timing of the intake valve caused by the shift from the intermediate-load operation to the idle operation, when a ratio RIVO is set to be 0%, according to the embodiment of the present invention.

FIGS. 29 and 30 show the change in valve operation angle operated by VEL 112, the change in advance amount of phase operated by VTC 113, and the change in opening timing IVO/closing timing IVC of intake valve 105, in the operation pattern shifting from the constant-speed operation to the idle operation. FIG. 29 shows the case where ratio RIVO is 50%, and FIG. 30 shows the case where ratio RIVO is 0%.

As shown in FIG. 29, in the case where there is employed VEL 112 in which both ratio RIVO and ratio RIVC are set to be 50% and the center phase does not vary while the valve operation angle varies, opening timing IVO can be retarded to the target timing by retarding the phase for only 30 deg by VTC 113. In contrast, in the case where there is employed VEL 112 in which ratio RIVO is set to be 0% so that opening timing IVO does not vary while the valve operation angle varies and the valve operation angle is decreased by advancing closing timing IVC, it is necessary to retard the phase for 40 deg by VTC 113.

Then, because of the difference in the required retard manipulated variable of the VTC 113, if ratio RIVO is 50%, opening timing IVO takes 0.16 sec to reach the target timing, whereas if ratio RIVO is 0%, opening timing IVO takes 0.22 sec to reach the target timing. Thus, from the viewpoint of engine stall resistance, it is undesirable to set ratio RIVO to an extremely small value.

Figure 31:
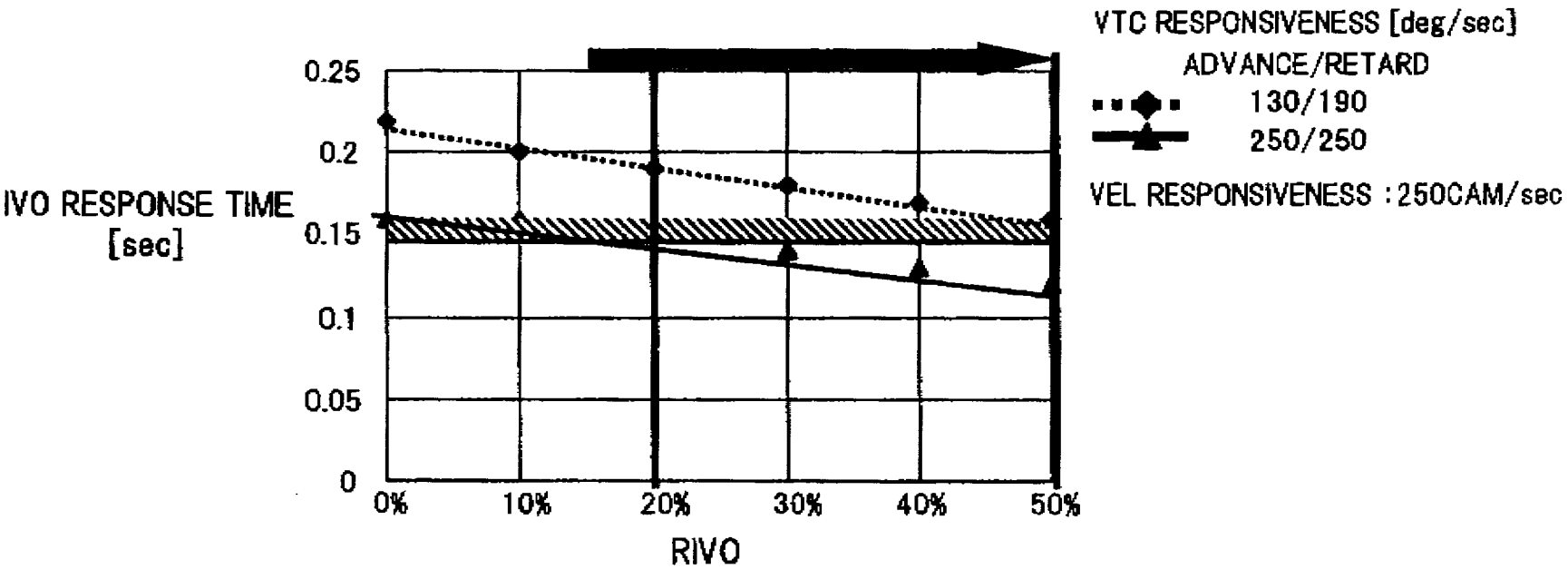
FIG. 31 is a graphical view illustrating a correlation between ratio RIVO and the response time of opening timing IVO according to the embodiment of the present invention.

Here, it should be noted that the response time for varying opening timing IVO can fall within the allowable range, if ratio RIVO is set within the range from 20% to 50%, as shown in FIG. 31.

As will be understood from the description above, as ratio RIVO approaches 50% from 0%, the response and fuel consumption at the transient operation become worse, on the other hand, as ratio RIVO approaches 0%, the engine stall resistance gets worse.

Taking the above into consideration, it will be understood that, for substantially satisfying the response at the transient operation, the low fuel consumption at the transient operation, and the engine stall resistance, ratio RIVO is to be set within the range from 20% to 40%, and more preferably, ratio RIVO is to be set at substantially 30%.

Therefore, in the present embodiment, by using VEL 112 in which ratio RIVO is set at 30%, the response at the transient operation, the low fuel consumption at the transient operation, and the engine stall resistance can be wholly and successfully improved.

The entire contents of Japanese Patent Application No. 2008-136293, filed May 26, 2008 are incorporated herein by reference.

While only selected embodiments have been chosen to illustrate the present invention, it will be apparent to those skilled in the art from this disclosure that various change and modification can be made without departing from the scope of the invention as defined in the appended claims.

Furthermore, the foregoing description of the embodiments according to the present invention is provided for illustrating purpose only, and not for the purpose of limiting the invention defined by the appended claims and its equivalents.

We claim:

1. A controlling apparatus for an engine provided with: a variable operation angle mechanism that is provided for varying a valve operation angle of an engine valve driven by a camshaft, and is capable of varying a center phase of the valve operation angle in response to a variation in the valve operation angle; and a variable valve timing mechanism provided for varying a rotating phase of the camshaft relative to a crankshaft of the engine, the controlling apparatus comprising:

a detecting unit that detects an operating state of the engine;

a first calculating unit that calculates a target valve operation angle based on the operating state;

a second calculating unit that calculates a target rotating phase based on the operating state;

a correcting unit that corrects the target rotating phase based on the target valve operation angle;

a first operating unit configured to calculate a first manipulated variable of the variable operation angle mechanism, based on the target valve operation angle, to thereby output the first manipulated variable; and a second operating unit configured to calculate a second manipulated variable of the variable valve timing mechanism, based on the target rotating phase corrected by the correcting unit, to thereby output the second manipulated variable, wherein the second calculating unit calculates, if the valve operation angle takes a reference value thereof, a target rotating phase which brings the center phase of the valve operation angle of the engine valve to approach a target center phase which is set depending on the operating state of the engine.

2. The controlling apparatus according to claim 1, wherein the engine valve comprises an intake valve, and wherein the variable operation angle mechanism varies a center phase of a valve operation angle of the intake valve in an advance direction in response to a decrease in the valve operation angle.

3. The controlling apparatus according to claim 2, wherein the variable operation angle mechanism is configured to operate under such a condition that a ratio of a change amount of an opening timing of the intake valve to a change amount of the valve operation angle is set to be equal to or more than 20% and equal to or less than 40%.

4. The controlling apparatus according to claim 2, wherein the variable operation angle mechanism is configured to operate under such a condition that a ratio of a change amount of an opening timing of the intake valve to a change amount of the valve operation angle is set to be 30%.

5. The controlling apparatus according to claim 1, wherein the correcting unit comprises a correction value calculating unit that calculates a correction value based on the target valve operation angle, and an add-subtract unit that performs addition of and subtraction between the target rotating phase and the correction value.

6. The controlling apparatus according to claim 5, wherein the correcting value calculating unit calculates the correction value having a greater absolute value as the target valve operation angle separates apart from the reference value.

7. The controlling apparatus according to claim 5, wherein the correction value calculating unit calculates a difference between a center phase of the valve operation angle for when the valve operation angle takes the reference value thereof and the rotating phase takes a reference value thereof, and a center phase of the valve operation angle for when the rotating phase takes the reference value thereof and the valve operation angle takes a target value thereof, and then calculates the correction value based on the difference.

8. The controlling apparatus according to claim 1, further comprising:

a load detecting unit that detects a variation in an engine load; and a gain setting unit that sets a larger gain in the first and second operating units, as the variation in the engine load turns abrupt.

9. The controlling apparatus according to claim 1, further comprising:

a diagnosing unit that diagnoses whether or not a failure of the variable operation angle mechanism occurs; and a failsafe unit that controls the variable valve timing mechanism so that the center phase of the valve operation angle of the engine valve is varied in a direction separating apart from a top dead center of a piston, when it is determined that the failure of the variable operation angle mechanism occurs.

10. The controlling apparatus according to claim 9, wherein the failsafe unit controls the variable valve timing mechanism at a larger gain than that of when the variable operation angle mechanism is normal.

11. The controlling apparatus according to claim 9, wherein the engine valve comprises an intake valve, and wherein the failsafe unit is configured to set a target rotating phase in the variable valve timing mechanism to be a most retarded position, when the failure of the variable operation angle mechanism occurs.

12. A controlling method of an engine provided with: a variable operation angle mechanism that is provided for varying a valve operation angle of an engine valve driven by a camshaft, and is capable of varying a center phase of the valve operation angle in response to a variation in the valve operation angle; and a variable valve timing mechanism provided for varying a rotating phase of the camshaft relative to a crankshaft of the engine, the controlling method comprising the steps of:

detecting an operating state of the engine;

calculating a target valve operating angle based on the operating state;

calculating a target rotating phase based on the operating state;

correcting the target rotating phase based on the target valve operation angle:

calculating a first manipulated variable of the variable operation angle mechanism based on the target valve operation angle;

outputting the first manipulated variable;

calculating a second manipulated variable of the variable valve timing mechanism based on the corrected target rotating phase; and outputting the second manipulated variable, wherein the step of calculating the target rotating phase is executed, if the valve operation angle takes a reference value thereof, to obtain a target rotating phase which brings the center phase of the valve operation angle of the engine valve to approach a target center phase which is set depending on the operating state of the engine.

13. The controlling method according to claim 12, wherein the step of correcting the target rotating phase comprises the steps of:

calculating a correction value based on the target valve operation angle; and performing addition of and subtraction between the target rotating phase and the correction value.

14. The controlling method according to claim 13, wherein the step of calculating the correction value is executed to obtain the correction value having a greater absolute value as the target valve operation angle separates apart from the reference value.

15. The controlling method according to claim 13, wherein the step of calculating the correction value comprises the steps of:

calculating a difference between a center phase of the valve operation angle for when the valve operation angle takes the reference value thereof and the rotating phase takes a reference value thereof, and a center phase of the valve operation angle for when the rotating phase takes the reference value thereof and the valve operation angle takes a target value thereof; and calculating the correction value based on the difference.

16. The controlling method according to claim 12, further comprising the steps of:

detecting a variation in an engine load; and setting a larger gain for calculating the first and second manipulated variables as the variation in the engine load turns abrupt.

17. The controlling method according to claim 12, further comprising the steps of:

diagnosing whether or not a failure of the variable operation angle mechanism occurs; and controlling the variable valve timing mechanism so that the center phase of the valve operation angle of the engine valve is varied in a direction separating apart from a top dead center of a piston, when it is determined that the failure of the variable operation angle mechanism occurs.

18. A controlling apparatus for an engine provided with: a variable operation angle mechanism that is provided for varying a valve operation angle of an engine valve driven by a camshaft, and is capable of varying a center phase of the valve operation angle in response to a variation in the valve operation angle; and a variable valve timing mechanism provided for varying a rotating phase of the camshaft relative to a crankshaft of the engine, the apparatus comprising:

detecting means for detecting an operating state of the engine;

first calculating means for calculating a target valve operation angle based on the operating state;

second calculating means for calculating a target rotating phase based on the operating state;

correcting means for correcting the target rotating phase based on the target valve operation angle;

first operating means for calculating a first manipulated variable of the variable operation angle mechanism, based on the target valve operation angle, thereby outputting the first manipulated variable; and second operating means for calculating a second manipulated variable of the variable valve timing mechanism, based on the target rotating phase corrected by the correcting means, thereby outputting the second manipulated variable, wherein the second calculating means calculates, if the valve operation angle takes a reference value thereof, a target rotating phase which brings the center phase of the valve operation angle of the engine valve to approach a target center phase which is set depending on the operating state of the engine.

* * * * *